US006604817B2

(12) United States Patent
Isono et al.

(10) Patent No.: US 6,604,817 B2
(45) Date of Patent: Aug. 12, 2003

(54) PRINT HEAD FOR PIEZOELECTRIC INK JET PRINTER, PIEZOELECTRIC ACTUATOR THEREFOR, AND PROCESS FOR PRODUCING PIEZOELECTRIC ACTUATOR

(75) Inventors: Jun Isono, Nagoya (JP); Atsuhiro Takagi, Kariya (JP); Atsushi Hirota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/798,986

(22) Filed: Mar. 6, 2001

(65) Prior Publication Data

US 2001/0020968 A1 Sep. 13, 2001

(30) Foreign Application Priority Data

Mar. 7, 2000 (JP) ..... 2000-062106
Mar. 15, 2000 (JP) ..... 2000-072678

(51) Int. Cl.[7] ..... B41J 2/045
(52) U.S. Cl. ..... 347/71
(58) Field of Search ..... 347/71, 72, 70, 347/68, 94; 29/25.35, 890.1; 216/95

(56) References Cited

U.S. PATENT DOCUMENTS 5,402,159 A 3/1995 Takahashi et al. ..... 347/9
5,963,234 A * 10/1999 Miyazawa et al. ..... 347/70
6,019,458 A * 2/2000 Shimada et al. ..... 347/70
6,109,738 A * 8/2000 Miyata et al. ..... 347/71
6,296,351 B1 * 10/2001 Tanaka et al. ..... 347/68
6,336,717 B1 * 1/2002 Shimada et al. ..... 347/71

* cited by examiner

*Primary Examiner*—Lamson Nguyen
*Assistant Examiner*—K. Feggins
(74) *Attorney, Agent, or Firm*—Oliff & Berridge, PLC

(57) ABSTRACT

A print head for a piezoelectric ink jet printer includes a piezoelectric actuator in the form of a plate, which lies on one side of a metallic cavity plate. The actuator includes drive electrodes and side electrodes. The side electrodes are formed on a side face of the actuator and each connected with one of the drive electrodes. The cavity plate has pressure chambers each aligned with one of the drive electrodes. The cavity plate also has nozzles each communicating with one of the chambers. The cavity plate further has a recess formed on the one side. The side electrodes are aligned with the recess to be kept out of contact with the cavity plate. Another print head for a piezoelectric ink jet printer includes a piezoelectric actuator in the form of a plate, which lies on a cavity plate. The actuator has recesses formed in a side face of it, and includes drive electrodes and side electrodes. Each side electrode is formed in one of the recesses and connected with one of the drive electrodes.

13 Claims, 20 Drawing Sheets

PRINT HEAD FOR PIEZOELECTRIC INK JET PRINTER, PIEZOELECTRIC ACTUATOR THEREFOR, AND PROCESS FOR PRODUCING PIEZOELECTRIC ACTUATOR

BACKGROUND OF THE INVENTION

1. Field of the Invention

The present invention relates to a print head for a piezoelectric ink jet printer, and more particularly to such a print head including a laminated piezoelectric actuator. The invention also relates to a piezoelectric actuator in the form of a plate for such a print head, and to a process for producing such actuators.

2. Description of the Related Art

U.S. Pat. No. 5,402,159 discloses a print head for a piezoelectric ink jet printer. The print head includes a cavity plate and a piezoelectric actuator in the form of a laminated plate. The cavity plate has nozzles and pressure chambers. The pressure chambers are open on one side of the cavity plate, and each communicate with one of the nozzles. The piezoelectric actuator includes piezoelectric sheets, sets of drive electrodes and some common electrodes. The drive electrodes and common electrodes are interposed between the piezoelectric sheets. Each set of drive electrodes is associated with one of the pressure chambers. The common electrodes are common to all the pressure chambers. The cavity plate lies on the piezoelectric actuator in such a manner that the actuator closes the pressure chambers.

As shown in FIGS. 11 and 15 of the foregoing patent, the piezoelectric actuator also includes side electrodes formed on side faces of it. Each side electrode is connected electrically to one of the sets of drive electrodes, and can be connected electrically to the outside. The side electrodes may come into contact with the cavity plate, which lies on the piezoelectric actuator. If the cavity plate is metallic, the contact short-circuits the side electrodes.

In order to prevent such short circuits, another conventional art of this type includes a cavity plate made of an alumina ceramic, which is an electrical insulator, or other non-conducting material. However, this cavity plate becomes larger in order to ensure a predetermined strength of the cavity plate. In addition, the material cost for the cavity plate is higher, and the processing steps for it becomes more complicated. As a result, the cost of the cavity plate is considerably higher.

Still another conventional art provides an insulating sheet between a cavity plate and a piezoelectric actuator in order to avoid the short circuit therebetween. The interposition of the insulating sheet allows the cavity plate to be made of metallic. The metallic cavity plate can be smaller and less costly than the cavity plate made of an alumina ceramic or other non-conducting material. However, the interposition of the insulating sheet increases the number of parts for the print head. The increased number of parts prevents the print head from being sufficiently small and inexpensive. In addition, the interposition of the insulating sheet increases the number of places where ink may leak.

In the foregoing patent, the side electrodes are formed on the side faces of the piezoelectric actuator by vacuum metallizing, metal spattering, conductive paste coating, or the like. The side electrodes rise slightly from the side faces. Consequently, while the piezoelectric actuator is produced or assembled, the side electrodes are very liable to be damaged by a handler, a jig or the like coming into contact with them. This causes defectives to be produced at a higher rate while piezoelectric actuators are produced.

SUMMARY OF THE INVENTION

It is an object of the present invention to provide an ink jet printer print head including a cavity plate and a piezoelectric actuator which lie on each other, the actuator including side electrodes provided on side faces of it and kept out of contact with the cavity plate without an insulating sheet interposed between the actuator and cavity plate.

It is another object to provide a piezoelectric actuator for an ink jet printer print head, the actuator including side electrodes provided in side faces of it without rising or protruding from them.

It is still another object to provide a process for producing such piezoelectric actuators at a low cost.

In accordance with a first aspect of the present invention, a print head is provided for a piezoelectric ink jet printer. The print head includes a piezoelectric actuator in the form of a plate. The actuator includes a piezoelectric sheet having a first face and a second face which are opposed to each other, and a side face connecting therebetween. The actuator further includes a common electrode lying on the first face of the piezoelectric sheet, a number of drive electrodes lying on the second face of the sheet, and side electrodes formed on the side face of the actuator. The common electrode lies over the drive electrodes. The side electrodes are each connected to one of the drive electrodes or one of the common and drive electrodes. The print head further includes a cavity plate having pressure chambers open on one side of the plate, nozzles each communicating with one of the chambers, and a recess formed on the one side. The actuator lies on the one side of the cavity plate in such a manner that the actuator closes the pressure chambers. The drive electrodes are each aligned with one of the chambers. The side electrodes are aligned with the recess to be kept out of contact with the cavity plate.

Thus, the recess of the cavity plate makes it possible to reliably keep the side electrodes of the piezoelectric actuator out of contact with the plate without interposing an insulating sheet between the plate and actuator. This enables the cavity plate to be metallic. It is consequently possible to reliably make the print head smaller and cheaper without increasing the number of places where ink may leak.

The piezoelectric actuator may further include outer electrodes formed on a surface of the actuator which is opposed to a surface of the actuator covering the one side of the cavity plate. The outer electrodes are each connected to one of the side electrodes. This simple actuator structure makes it possible to connect the outer electrodes reliably to the wiring patterns of a flexible flat cable for connection to external apparatus or equipment by pressing the cable against that surface of the piezoelectric actuator on which the outer electrodes lie.

The piezoelectric actuator may further include a second piezoelectric sheet lying on the first piezoelectric sheet and a third piezoelectric sheet lying on the one side of the cavity plate. The first piezoelectric sheet lies between the second and third piezoelectric sheets. The common electrode lies between the first and second piezoelectric sheets. The drive electrodes lie between the first and third piezoelectric sheets. The outer electrodes lie on the second piezoelectric sheet.

The recess of the cavity plate may be a groove extending along the side surface of the piezoelectric actuator. The groove for all the side electrodes is less costly to form than recesses for the respective side electrodes.

The cavity plate may include a base sheet lying on the one side. The recess may be a slot punched in the base sheet.

In accordance with a second aspect of the present invention, a piezoelectric ink jet printer print head is provided. This print head includes a cavity plate having a plurality of nozzles and pressure chambers each communicating with one of the nozzles, and an actuator lying on one side of the cavity plate. The actuator includes a piezoelectric sheet having a first face and a second face opposed to the first face and a side face connecting the fist and second faces. The side face has recesses formed thereon. The actuator further includes drive electrodes, a common electrode and side electrodes. The drive electrodes lie on the second face of the piezoelectric sheet, and are each exposed in one of the recesses. The drive electrodes are each aligned with one of the pressure chambers. Each side electrode is formed in one of the recesses, and connected to the drive electrode exposed in the associated recess. The common electrode lies on the first face of the piezoelectric sheet over the drive electrodes.

Because the side electrodes are positioned in the recess, they do not rise or protrude from the third side of the piezoelectric actuator. Consequently, while the actuator of the printer is produced or assembled, it is possible to reliably reduce the liability of the side electrodes to be damaged by a handler, a jig or the like coming into contact with them.

This piezoelectric ink jet printer may further include outer electrodes formed on a surface of the actuator which is opposed to a surface of the actuator covering the cavity plate. The outer electrodes are each connected to one of the side electrodes. This simple actuator structure makes it possible to connect the outer electrodes reliably to the wiring patterns of a flexible flat cable for connection to external apparatus or equipment by pressing the cable against that side of the piezoelectric actuator on which the outer electrodes lie.

The piezoelectric actuator may further include an insulating sheet and a second piezoelectric sheet. The insulating sheet lies on the first piezoelectric sheet. The second piezoelectric sheet lies on the one side of the cavity plate when the actuator lies on the one side. The first piezoelectric sheet lies between the insulating sheet and the second piezoelectric sheet. The common electrode lies between the insulating sheet and the first piezoelectric sheet. The drive electrodes lie between the first-mentioned and second piezoelectric sheets. The outer electrodes lie on the insulating sheet.

In accordance with a third aspect of the present invention, a piezoelectric actuator is provided, which is in the form of a plate for a piezoelectric ink jet printer print head including a cavity plate on which the actuator is placed. The cavity plate having a plurality of nozzles and pressure chambers each communicating with one of the nozzles, the actuator comprises: a piezoelectric sheet having a first face and a second face opposed to the first face and a side face connecting the first and second faces, the side face having recesses formed thereon; drive electrodes lying on the second face of the piezoelectric sheet and each exposed in one of the recesses, the drive electrodes being each aligned with one of the pressure chambers; side electrodes each formed in one of the recesses and each connected to the drive electrode exposed in the associated recess; and a common electrode lying on the first face of the piezoelectric sheet over the drive electrodes.

In accordance with a fourth aspect of the present invention, a process for producing piezoelectric actuators for piezoelectric ink jet printer print heads is provided, which comprises the steps of:

providing a first green sheet including at least two first matrices defined on both sides of a first boundary;

forming drive electrodes in each of the first matrices on one side of the first green sheet in such a manner that each of the drive electrodes crosses the first boundary;

providing a second green sheet including at least two second matrices defined on both sides of a second boundary;

forming a common electrode in each of the second matrices on one side of the second green sheet in such a manner that the common electrode crosses the second boundary;

joining the two green sheets together to form a laminate in such a manner that the other side of one of the sheets lies on the one side of the other sheet, that the first and second boundaries are aligned with each other;

making a through hole on first and second boundaries in the laminate;

cutting the laminate along the boundaries to separate the matrices of each of the green sheets from each other and divide the through hole into two recesses; and forming a side electrode in each of the recesses in such a manner that the side electrode is connected to the associated drive electrode.

The process makes it possible to form recesses in side faces of piezoelectric actuators simply by making through holes, and to produce two or more piezoelectric actuators at the same time. It is consequently possible to produce piezoelectric actuators at low cost.

The process may further comprises the steps of: providing a third green sheet including at least two third matrices defined on both sides of a third boundary; and forming outer electrodes in each of the third matrices on one side of the third green sheet in such a manner that each of the outer electrodes corresponds to one of the driving electrodes; wherein, in the joining step, the first, second and third green sheets may be joined together to form the laminate in such a manner that the other side of the third green sheet lies on the one side of the second green sheet, and that the first, second and third boudoirs are aligned with each other, and in the forming step of the side electrode, the side electrode in each of the recesses may be formed in such a manner that the side electrode is connected to the associated drive electrode and the associated outer electrode.

In accordance with a fifth aspect of the present invention, a process for producing piezoelectric actuators for piezoelectric ink jet printer print heads is provide, which comprises the steps of:

providing a first green sheet including at least two first matrices defined on both sides of a first boundary;

forming drive electrodes in each of the first matrices on one side of the first green sheet in such a manner that each of the drive electrodes crosses the first boundary;

providing a second green sheet including at least two second matrices defined on both sides of a second boundary;

forming a common electrode in each of the second matrices on one side of the second green sheet in such a manner that the common electrode crosses the second boundary;

joining the two green sheets together to form a laminate in such a manner that the other side of one of the sheets lies on the one side of the other sheet, that the first and second boundaries are aligned with each other;

making a through hole on first and second boundaries in the laminate;

filling an electrically conductive paste into the through hole in such a manner that the paste is connected to the drive electrodes;

drying the filled paste; and cutting the laminate along the boundaries to separate the matrices of each of the green sheets from each other, divide the through hole into two recesses, and divide the dried paste into two side electrodes each in one of the recesses.

The process of the fifth aspect may further comprises the steps of: providing a third green sheet including at least two third matrices defined on both sides of a third boundary; and forming outer electrodes in each of the third matrices on one side of the third green sheet in such a manner that each of the outer electrodes corresponds to one of the driving electrodes; wherein, in the joining step, the first, second and third green sheets may be joined together to form the laminate in such a manner that the other side of the third green sheet lies on the one side of the second green sheet, and that the first, second and third boudoirs may be aligned with each other.

This process makes it possible to produce piezoelectric actuators at lower cost than the process of the fourth aspect, which includes the step of forming side electrodes after cutting the laminate.

In each of the processes according to the fourth and fifth aspects, the step of forming outer electrodes may include forming a narrow electrode pattern on the one side of the third green sheet in such a manner that the pattern extends along the third boundary and connects the outer electrodes together. The process may further comprise the step of forming metal skins on the outer electrodes by electroplating these electrodes with an electric current applied to them via the electrode pattern. This pattern is removed at the same time that the laminate is cut. This makes it possible to produce, at low cost, piezoelectric actuators each for improved electric connection with a flexible flat cable.

Thus, by electroplating the outer electrodes with an electric current applied to them via the electrode pattern connecting them electrically together, it is possible to form metal skins, which may be gold, simultaneously on the outer electrodes. This makes it possible to improve the electric connection of the outer electrodes of each piezoelectric actuator with a flexible flat cable reliably without greatly raising the cost of production. At the same time that the laminate is cut, the electrode pattern is removed to electrically insulate the outer electrodes from each other and the side electrodes from each other.

BRIEF DESCRIPTION OF THE DRAWINGS

Preferred embodiments of the present invention will be described below with reference to the accompanying drawings, in which.

DETAILED DESCRIPTION OF THE PREFERRED EMBODIMENTS

Embodiment 1

FIGS. 1–7 show a print head embodying the present invention for a piezoelectric ink jet printer. As shown FIG. 1, the print head includes a metallic cavity plate 10, a piezoelectric actuator 20 in the form of a plate, and a flexible flat cable 30 for connection with external equipment or apparatus. The cable 30 is bonded to the actuator 20, which lies on the cavity plate 10.

Figure 5:
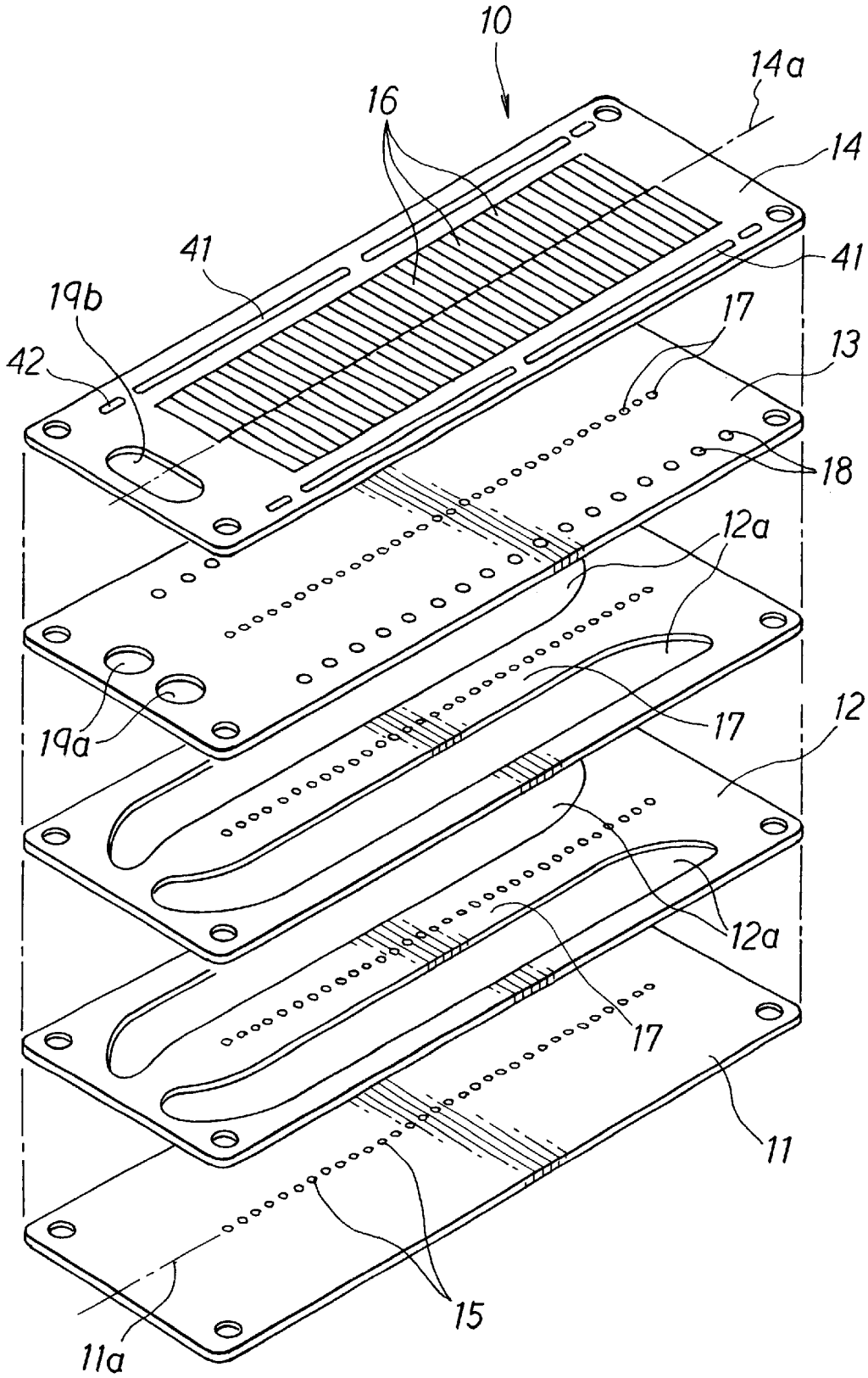
FIG. 5 is an exploded perspective view of the cavity plate.
Figure 6:
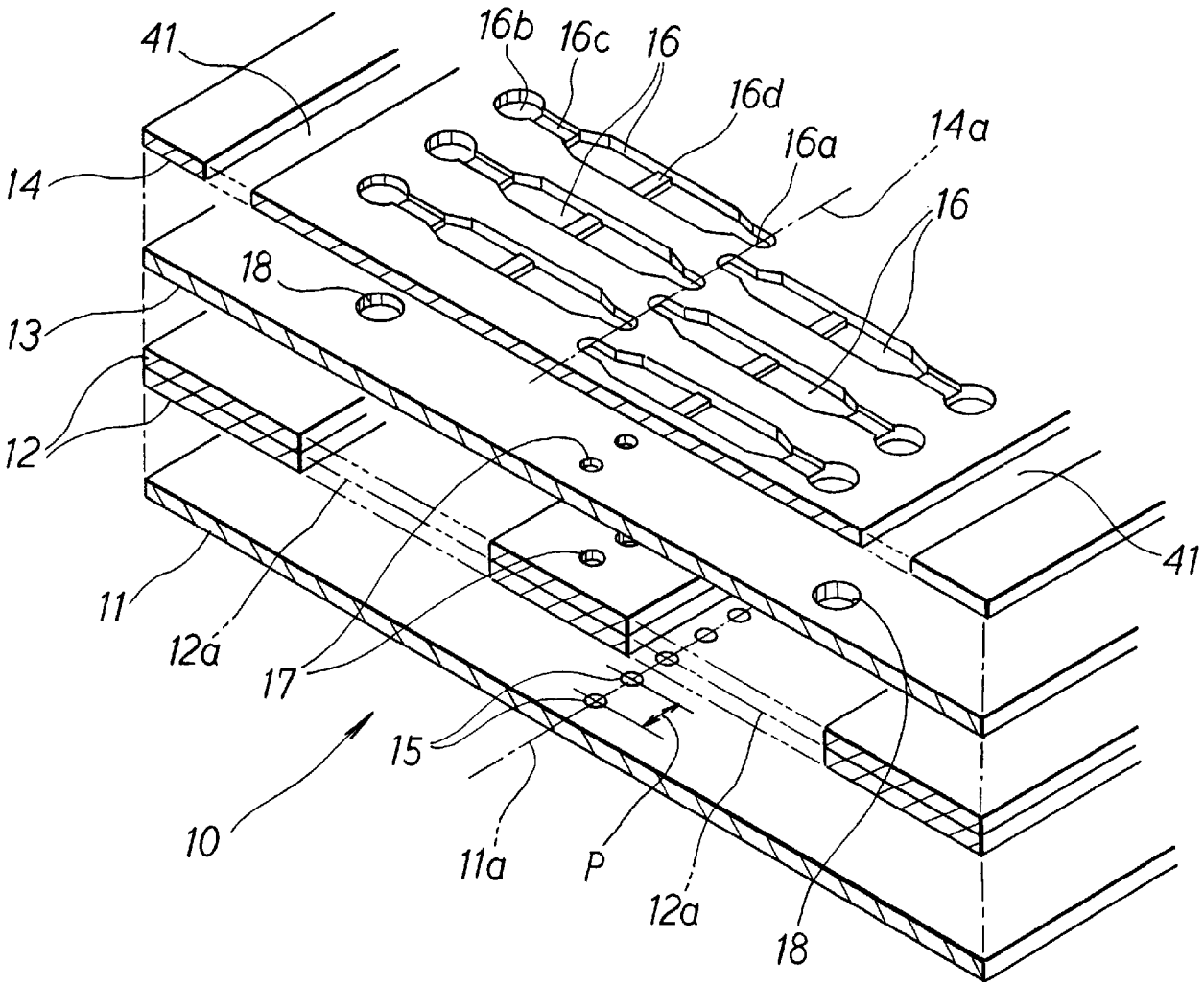
FIG. 6 is an exploded perspective view of a portion of the cavity plate.

With reference to FIGS. 5 and 6, the structure of cavity plate 10 will be explained. The cavity plate 10 is a laminate of five thin metal plates or sheets, which are a nozzle plate 11, two manifold plates 12, a spacer plate 13 and a base plate 14.

The nozzle plate 11 has a line of nozzles 15 for ejection of ink, which have a minute diameter. The nozzles 15 are formed through the nozzle plate 11 at a minute pitch P on the longitudinal center line 11*a* of the nozzle plate.

Each manifold plate 12 has a line of orifices 17 formed through it and each aligned with one of the nozzles 15. The orifices 17 have a minute diameter. Each manifold plate 12 also has two ink passages 12*a* formed through it on both sides of and along the line of orifices 17. The ink passages 12*a* are closed by the nozzle plate 11 and spacer plate 13, between which the manifold plates 12 are interposed.

The spacer plate 13 has a line of orifices 17 formed through it and each aligned with one of the nozzles 15. The orifices 17 have a minute diameter. The spacer plate 13 also has two lines of holes 18 formed through it over the ink passages 12*a*. The spacer plate 13 further has two supply holes 19*a* formed through its one end portion. Each supply hole 19*a* communicates with one of the ink passages 12*a* of each manifold plate 12.

The base plate 14 has a number of narrow pressure chambers 16 formed through and in it. The pressure chambers 16 extend perpendicularly to the longitudinal center line 14*a* of the base plate, which is parallel to the center line 11*a* of the nozzle plate. Every other pressure chamber 16 extends in the opposite direction. As seen in FIG. 6, the inner ends 16*a* of the pressure chambers 16 are positioned on the center line 14*a*, and each aligned with one of the nozzles 15 to communicate through the associated orifices 17 with the associated nozzle 15. The outer ends 16*b* of the pressure chambers 16 are each aligned with one of the holes 18 of the spacer plate 13 to communicate through the associated hole 18 with the adjacent ink passages 12*a* of the manifold plates 12. The base plate 14 also has a supply hole 19*b* formed through its one end portion. The supply hole 19*b* communicates with the supply holes 19*a* of the spacer plate 13.

Ink can flow through the supply holes 19*b* and 19*a* into the ink passages 12*a*, from which it can be distributed through the respective holes 18 to the respective pressure chambers 16. Ink can then flow from the pressure chambers 16 through the respective orifices 17 into the respective nozzles 15.

Each pressure chamber 16 includes a choke or throttle 16*c* for flow restriction or regulation, which is adjacent to its outer end 16*b*. The choke 16*c* takes the form of a groove in the base plate 14. A reinforcing rib or bar 16*d* extends across a middle portion of each pressure chamber 16. The rib 16*d* is integral with and thinner than the base plate 14.

Figure 1:
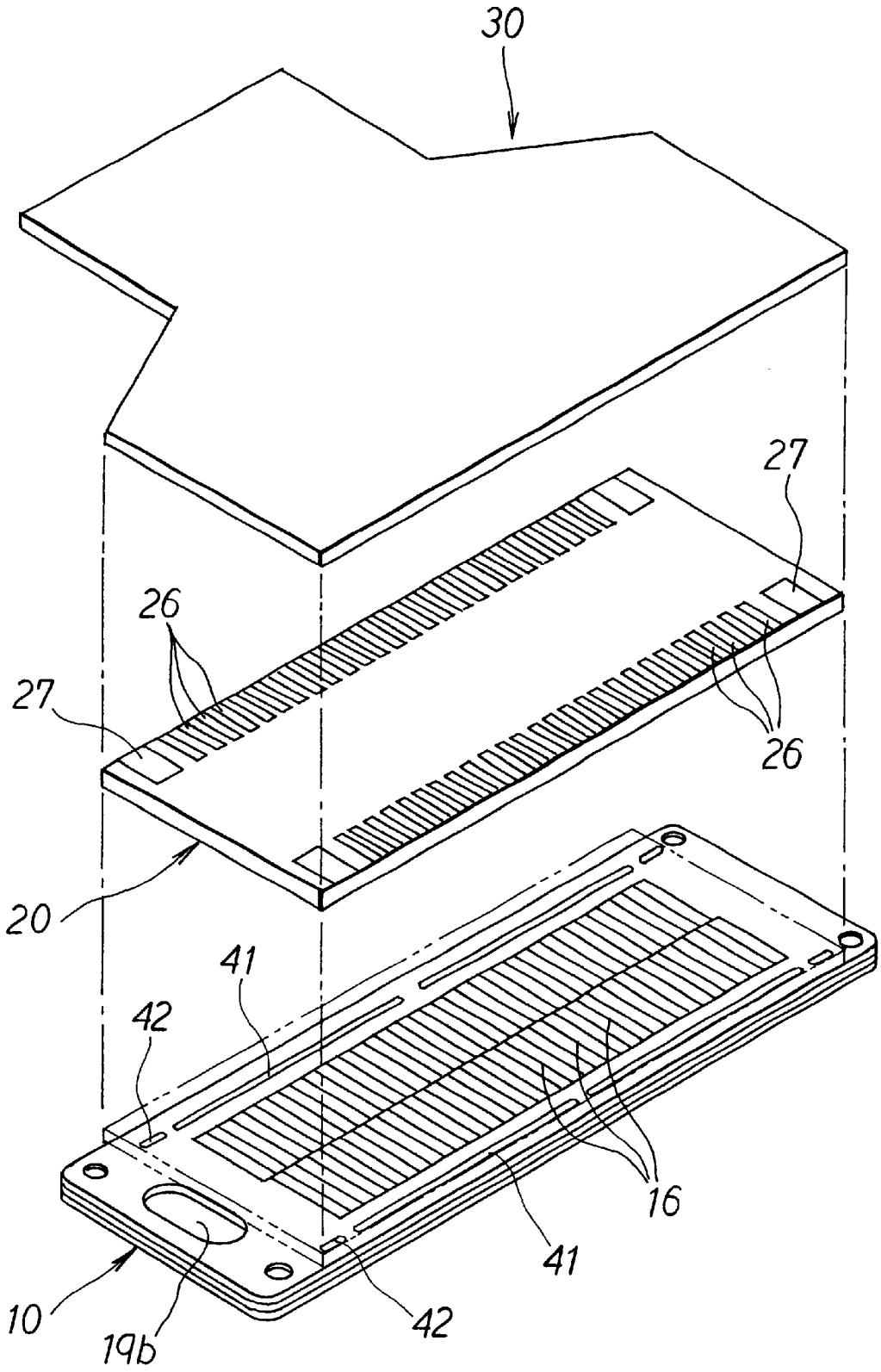
FIG. 1 is an exploded perspective view of a print head embodying the invention for a piezoelectric ink jet printer.
Figure 2:
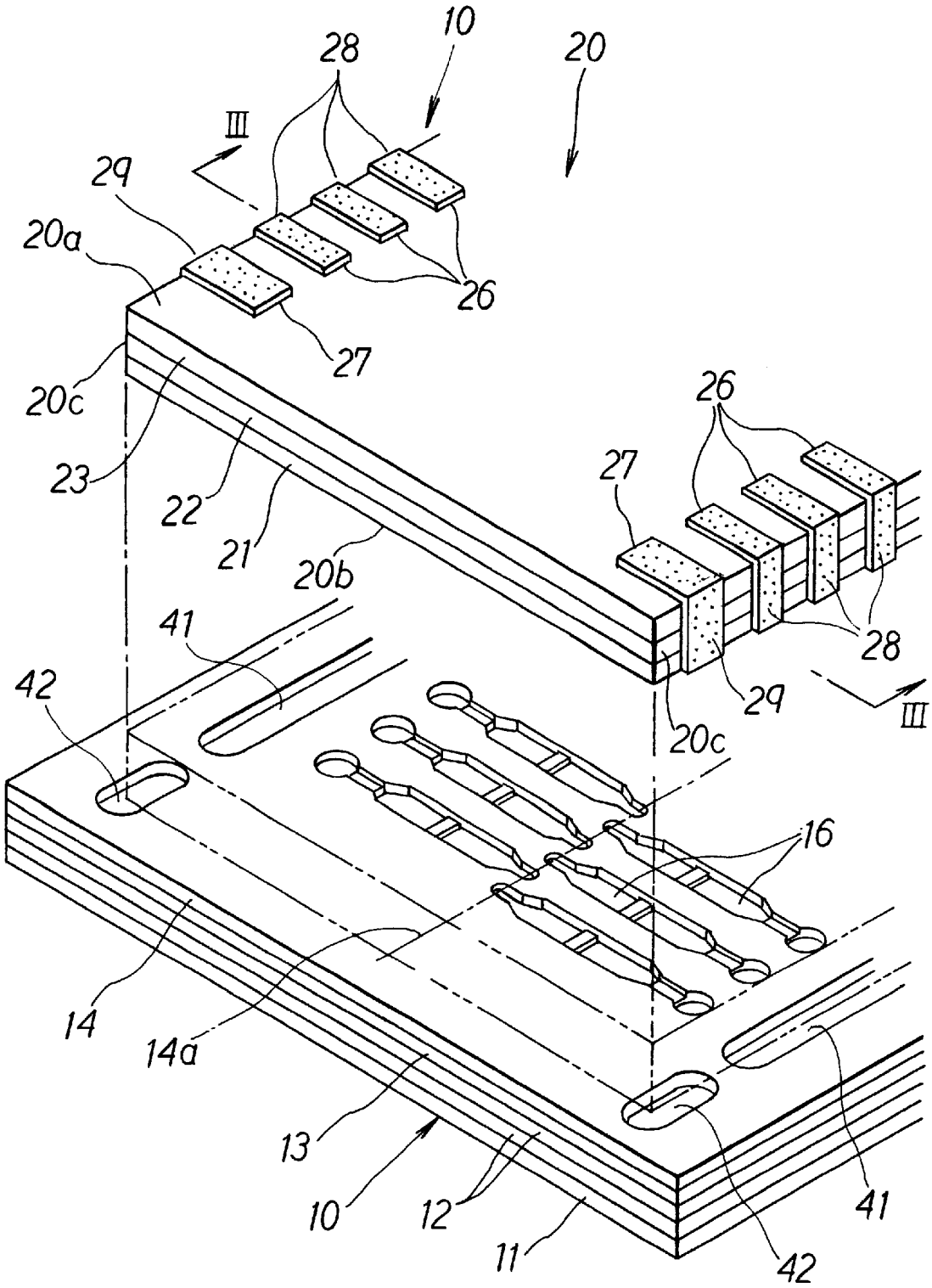
FIG. 2 is an exploded perspective view of portions of the piezoelectric actuator and cavity plate of the print head.
Figure 3:
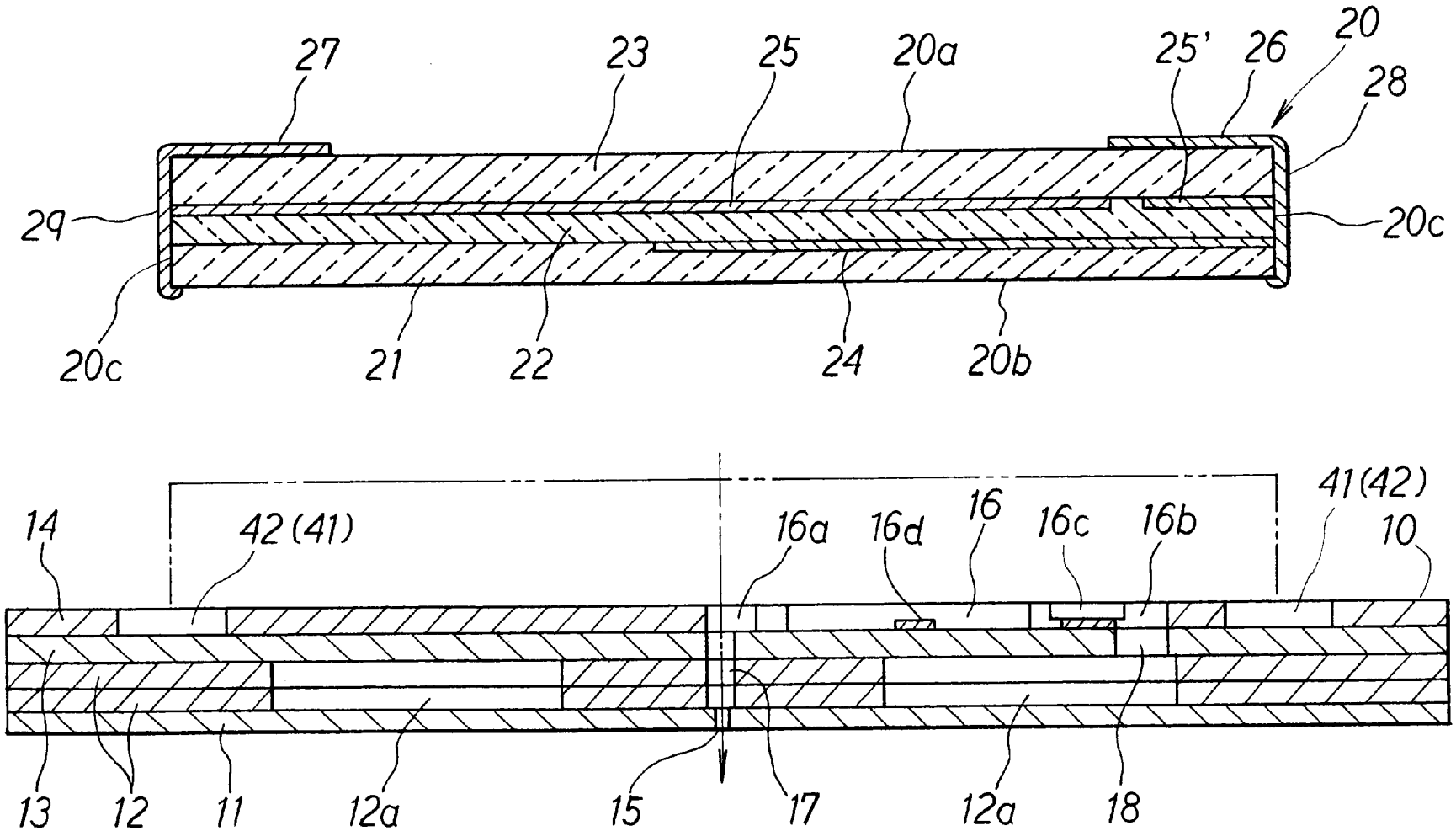
FIG. 3 is a cross section taken along line III—III of FIG. 2.
Figure 4:
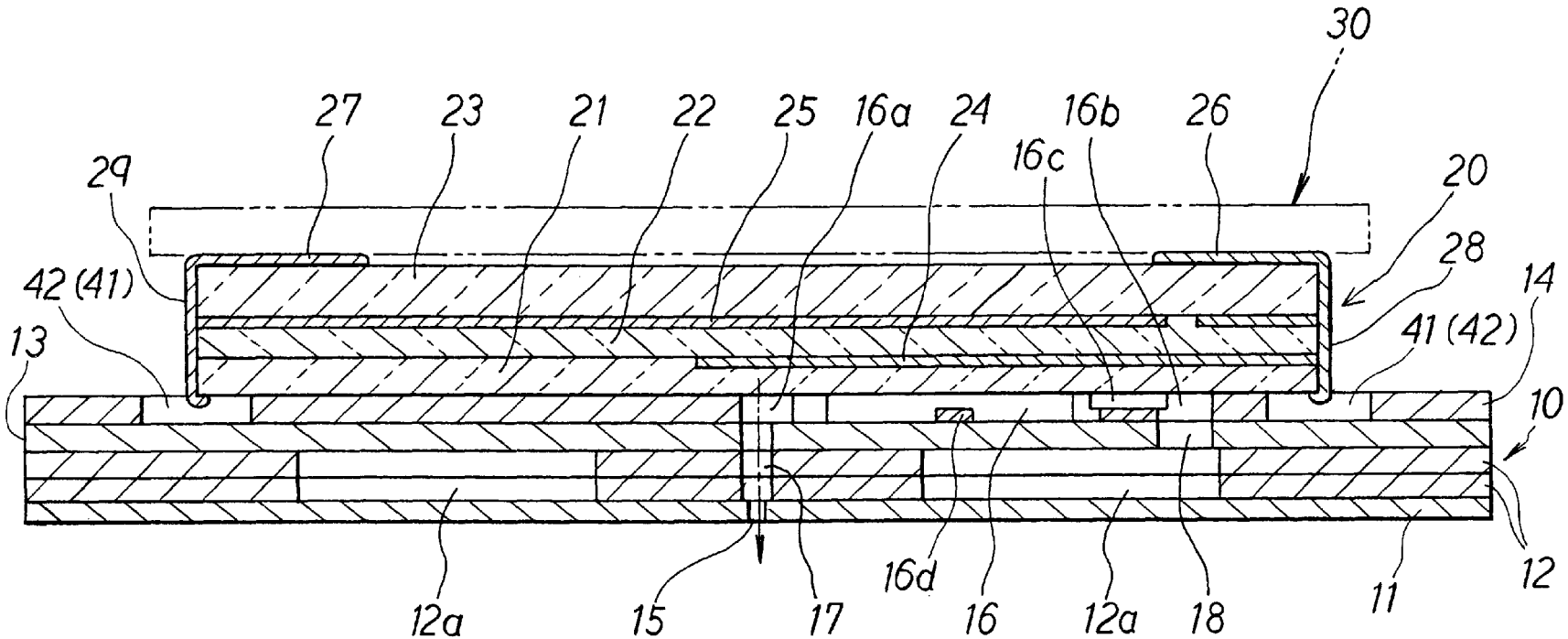
FIG. 4 is a cross section of the piezoelectric actuator and cavity plate.
Figure 7:
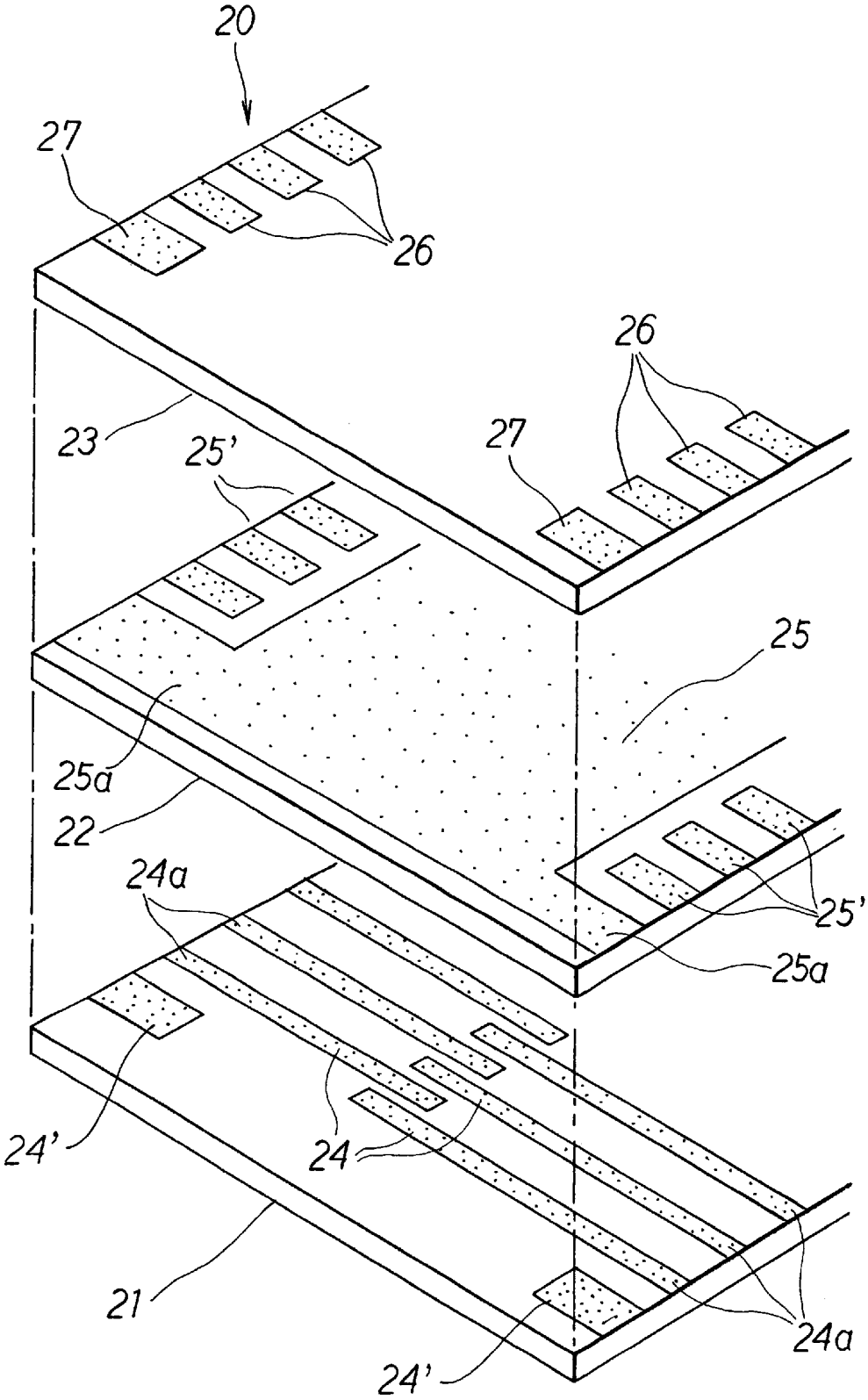
FIG. 7 is an exploded perspective view of the end portion of the piezoelectric actuator.

With reference to FIGS. 2 and 7, the piezoelectric actuator 20 is a laminate of three piezoelectric sheets 21, 22 and 23.

The bottom piezoelectric sheet 21 has narrow drive electrodes 24 formed on its top face and each positioned over one of the pressure chambers 16 of the cavity plate 10. The outer ends 24*a* of the drive electrodes 24 are exposed on the right and left side faces 20*c* of the piezoelectric actuator 20, which are perpendicular to the top face 20*a* and the bottom face 20*b* of the actuator 20. This piezoelectric sheet 21 also has dummy electrodes 24'.

The middle piezoelectric sheet 22 has a common electrode 25 formed on its top face and positioned over the drive electrodes 24. The common electrode 25 is common to all the pressure chambers 16. The common electrode 25 includes four terminals 25*a* exposed on the side faces 20*c* of the piezoelectric actuator 20. This piezoelectric sheet 22 also has dummy electrodes 25'.

The top piezoelectric sheet 23 has top electrodes 26 and 27 formed on its top face along the side faces 20*c* of the piezoelectric actuator 20. Each top electrode 26 is positioned over one of the drive electrodes 24. Each top electrode 27 is positioned over one of the terminals 25*a* of the common electrode 25.

The piezoelectric actuator 20 has side electrodes 28 and 29 formed on the side faces 20*c* as shown in FIG. 2. Each of the side electrodes 28 connects one of the top electrodes 26 electrically with the associated drive electrode 24. Each of the side electrodes 29 connects one of the top electrodes 27 electrically with the associated terminal 25*a* of the common electrode 25.

The piezoelectric actuator 20 might include two or more piezoelectric sheets 21 each having drive electrodes 24 and two or more piezoelectric sheets 22 each having a common electrode 25. Each of these piezoelectric sheets 21 is paired with one of these piezoelectric sheets 22. These piezoelectric sheets 21 and 22 lie alternately on each other.

The piezoelectric actuator 20 lies on the cavity plate 10 in such a manner that the actuator bottom face 20*b* closes the pressure chambers 16 of the cavity plate 10. The flexible flat cable 30 is pressed on the actuator top face 20*a* so that the wiring patterns (not shown) of the cable 30 are connected electrically with the top electrodes 26 and 27 of the piezoelectric actuator 20.

When voltage is applied between any of the drive electrodes 24 and the common electrode 25, those portions of the piezoelectric sheets 21 and 22 which are positioned over and under this particular drive electrode or these particular drive electrodes 24 deform piezoelectrically in the downward direction. The downward deformation reduces the volume of the associated pressure chamber or chambers 16. The volume reduction ejects an ink droplet or ink droplets from the pressure chamber or chambers 16 through the associated orifices 17 and nozzle or nozzles 15, so that printing can be done.

The base plate 14 of the cavity plate 10 has four slots 41 and four holes 42 punched in it along the side faces 20*c* of the piezoelectric actuator 20. The slots 41 extend under the side electrodes 28 of the actuator 20. The holes 42 are each positioned under one of the side electrodes 29 of the actuator 20. The slots 41 and holes 42 keep the side electrodes 28 and 29 out of contact with the metallic cavity plate 10, reliably preventing short circuits between the electrodes 28 and between the electrodes 28 and 29.

The slots 41 may be replaced by holes each punched under one of the side electrodes 28. However, it is possible to form at lower cost the slots 41 extending along the side faces 20*c* of the piezoelectric actuator 20, as illustrated.

It is easy to form the slots 41 and holes 42 by using a punching press.

Figure 8:
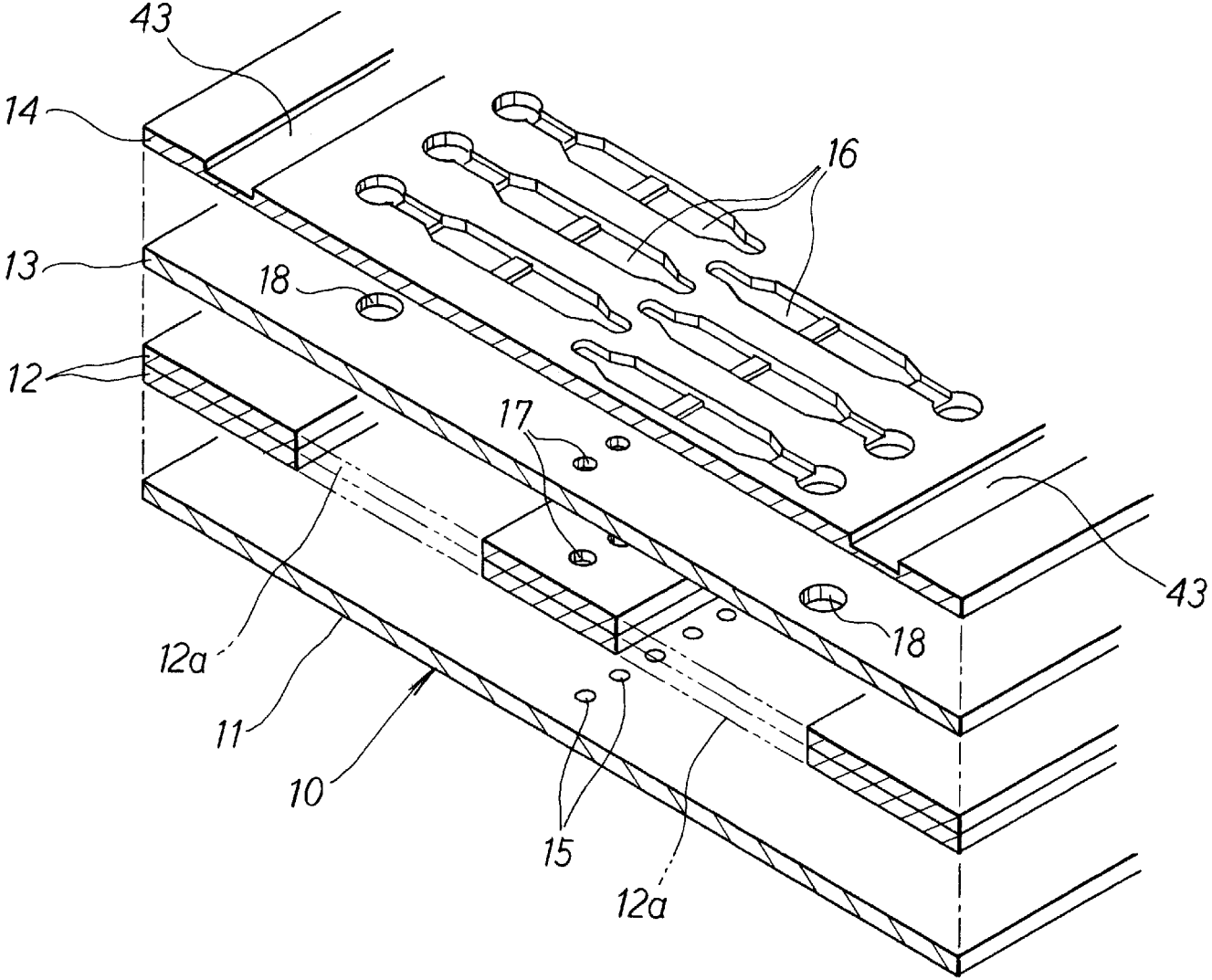
FIG. 8 is an exploded perspective view of a portion of a modified cavity plate for use in place of the foregoing cavity plate.

FIG. 8 shows a modified cavity plate 10 for use in place of the foregoing cavity plate 10. This cavity plate 10 includes a base plate 14 having two grooves 43 formed on its top side in place of the punched holes 41 and 42. The grooves 43 extend under the side electrodes 28 and 29 along the side faces 20*c* of the piezoelectric actuator 20. Likewise, the grooves 43 keep the side electrodes 28 and 29 out of contact with the metallic cavity plate 10. In comparison with the punched holes 41 and 42, the grooves 43 avoid lowering the strength of the base plate 14.

The grooves 43 may be replaced by recesses each formed under one of the side electrodes 28 and 29.

Embodiment 2

FIGS. 9–15 show still another print head embodying the present invention for a piezoelectric ink jet printer. This print head includes a metallic cavity plate 10, a piezoelectric actuator 20 in the form of a plate, and a flexible flat cable 40 for connection with external equipment or apparatus. The cable 40 is bonded to the actuator 20, which lies on the cavity plate 10.

Figure 13:
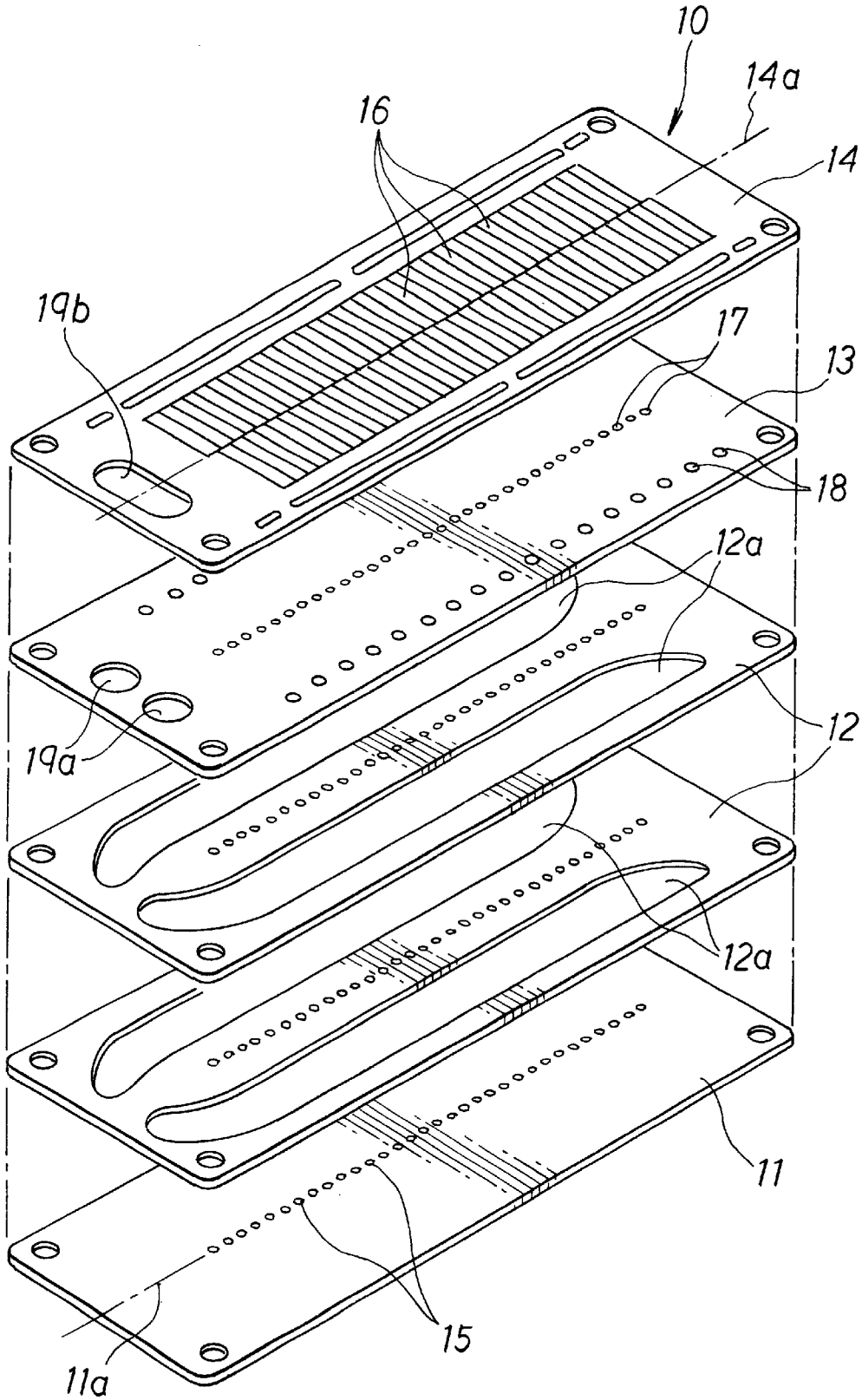
FIG. 13 is an exploded perspective view of this cavity plate.
Figure 14:
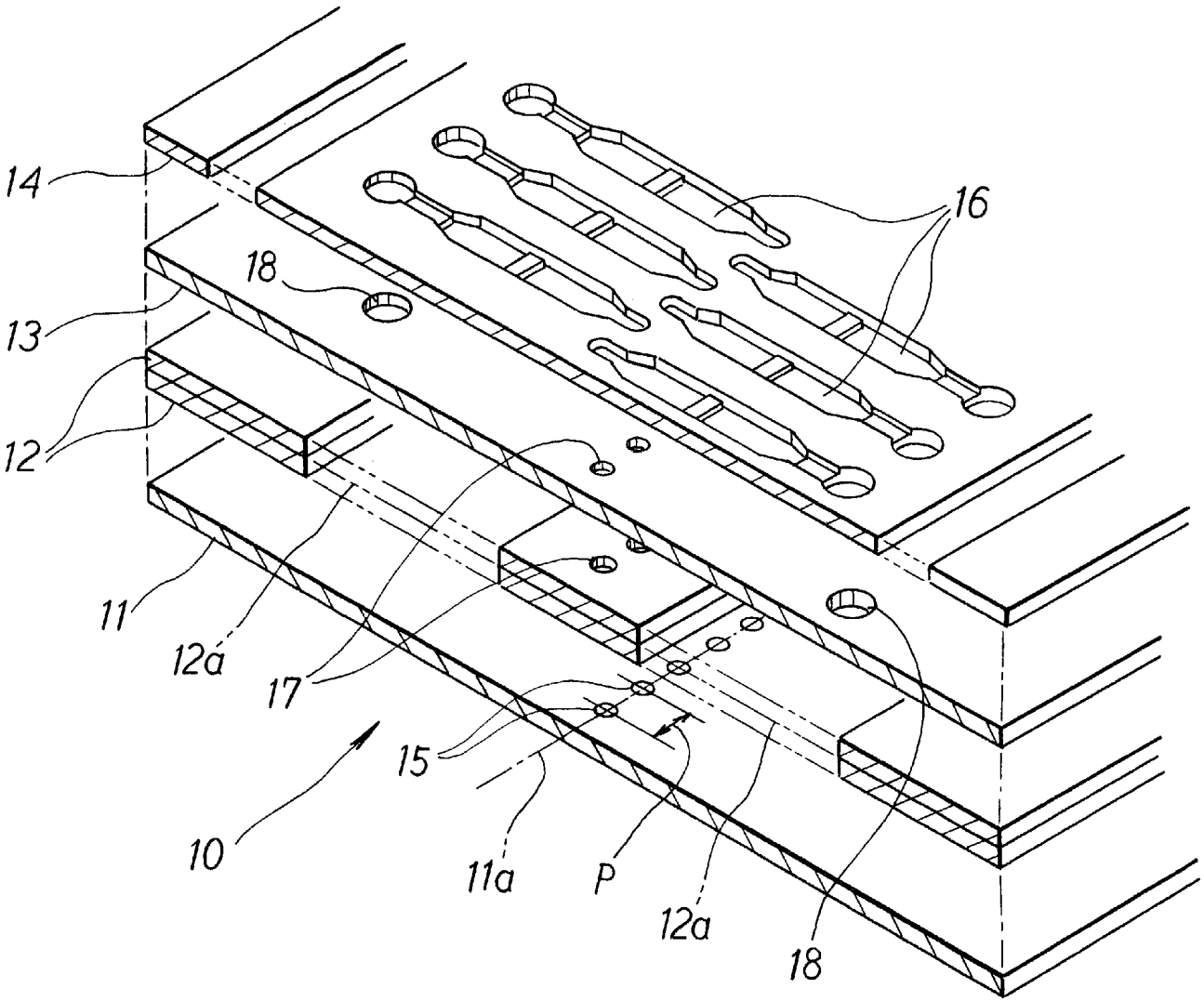
FIG. 14 is an exploded perspective view of a portion of this cavity plate.

With reference to FIGS. 13 and 14, the cavity plate 10 is a laminate of five thin metal plates or sheets, which are a nozzle plate 11, two manifold plates 12, a spacer plate 13 and a base plate 14.

The nozzle plate 11 has a line of nozzles 15 for ejection of ink, which have a minute diameter. The nozzles 15 are formed through the nozzle plate 11 at a minute pitch P on the longitudinal center line 11*a* of this plate.

Each manifold plate 12 has a line of orifices 17 formed through it and each aligned with one of the nozzles 15. The orifices 17 have a minute diameter. Each manifold plate 12 also has two ink passages 12*a* formed through it on both sides of and along the line of orifices 17. The ink passages 12*a* are closed by the nozzle plate 11 and spacer plate 13, between which the manifold plates 12 are interposed.

The spacer plate 13 has a line of orifices 17 formed through it and each aligned with one of the nozzles 15. The orifices 17 have a minute diameter. The spacer plate 13 also has two lines of holes 18 formed through it over the ink passages 12*a*. The spacer plate 13 further has two supply holes 19*a* formed through its one end portion. Each supply hole 19*a* communicates with one of the ink passages 12*a* of each manifold plate 12.

The base plate 14 has a number of narrow pressure chambers 16 formed through and in it and extending perpendicularly to its longitudinal center line 14*a*, which is parallel to the center line 11*a* of the nozzle plate. Every other pressure chamber 16 extends in the opposite direction. The inner ends 16*a* of the pressure chambers 16 are positioned on the center line 14*a*, and each aligned with one of the nozzles 15 to communicate through the associated orifices 17 with the associated nozzle 15. The outer ends 16*b* of the pressure chambers 16 are each aligned with one of the holes 18 of the spacer plate 13 to communicate through the associated hole 18 with the adjacent ink passages 12*a* of the manifold plates 12. The base plate 14 also has a supply hole 19*b* formed through its one end portion. The supply hole 19*b* communicates with the supply holes 19*a* of the spacer plate 13.

Ink can flow through the supply holes 19*b* and 19*a* into the ink passages 12*a*, from which it can be distributed through the respective holes 18 to the respective pressure chambers 16. Ink can then flow from the pressure chambers 16 through the respective orifices 17 into the respective nozzles 15.

Figure 10:
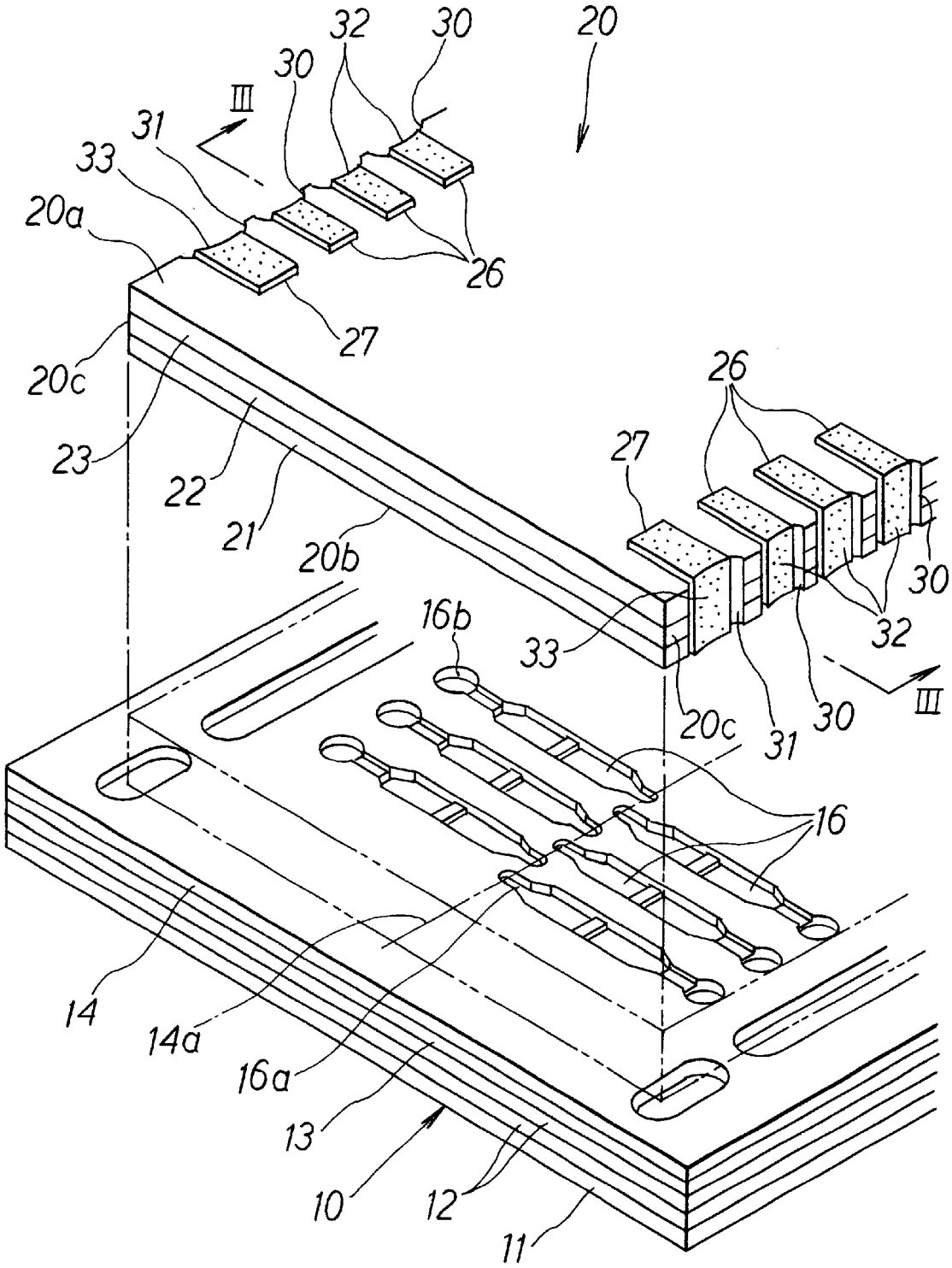
FIG. 10 is an exploded perspective view of portions of the piezoelectric actuator and cavity plate of this print head.
Figure 11:
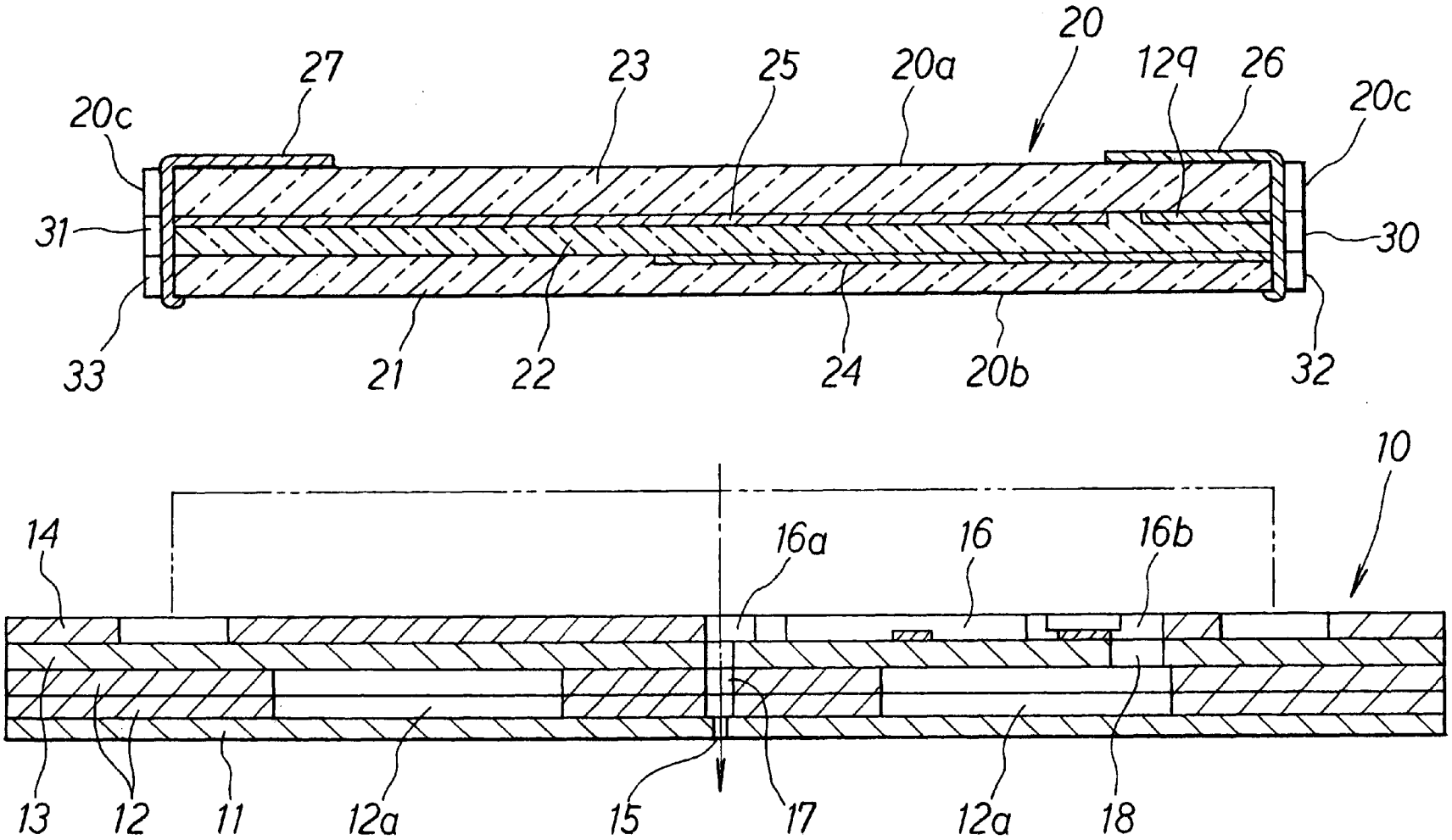
FIG. 11 is a cross section taken along line XI—XI of FIG. 10.
Figure 12:
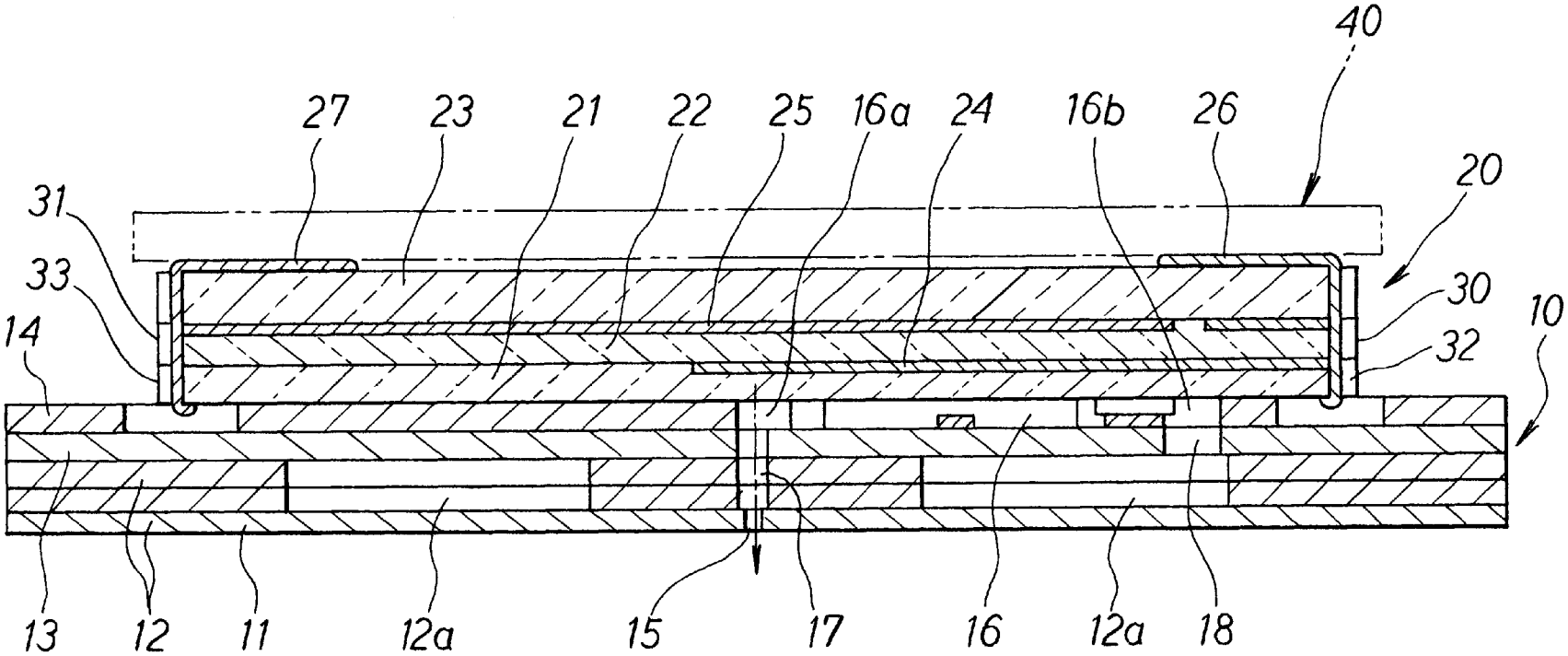
FIG. 12 is a cross section of the piezoelectric actuator and cavity plate of this print head.
Figure 15:
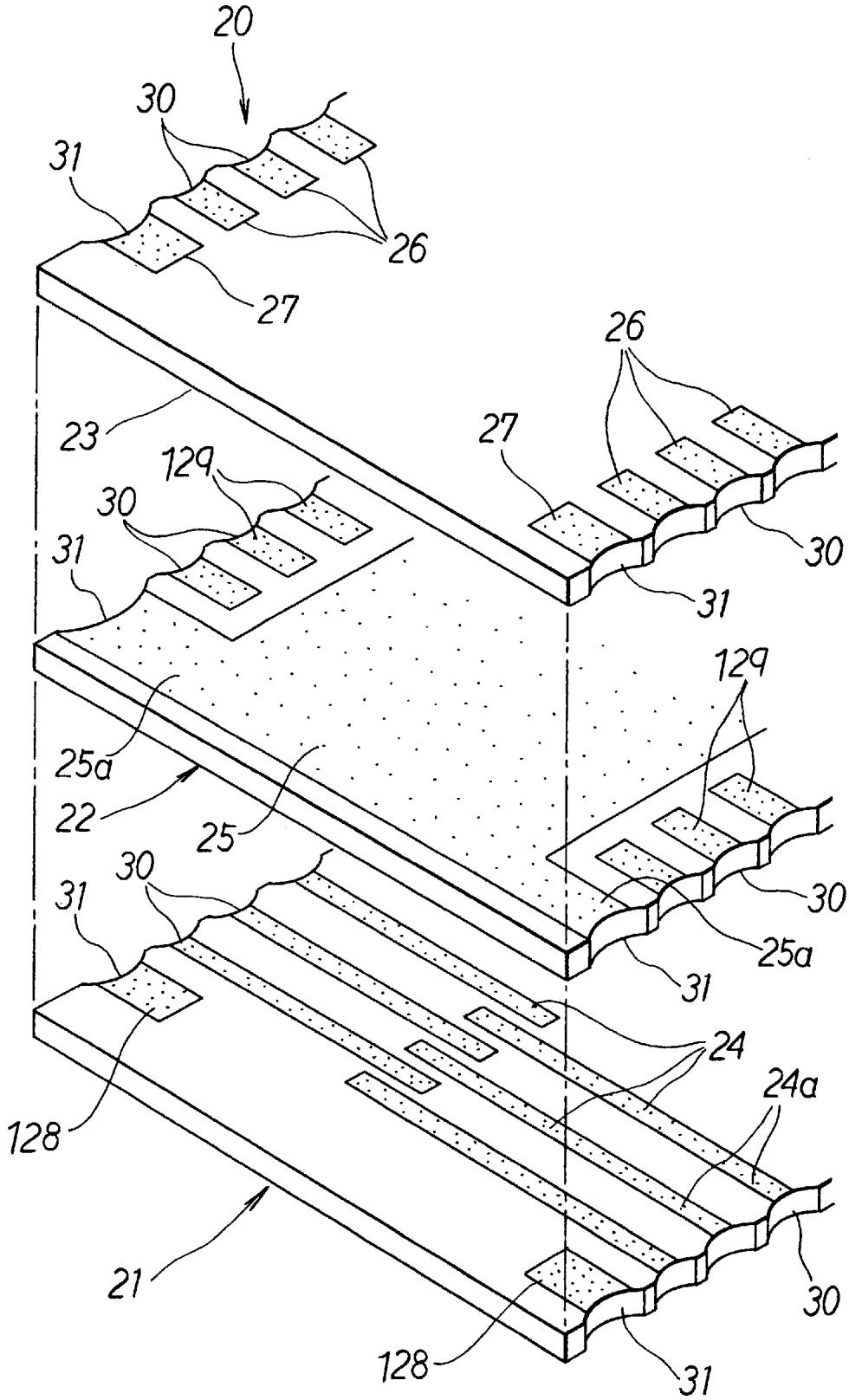
FIG. 15 is an exploded perspective view of the end portion of the piezoelectric actuator shown in FIGS. 9–12.

With reference to FIGS. 10 and 15, the piezoelectric actuator 20 is a laminate of two piezoelectric sheets 21 and 22 and an insulating sheet 23.

The lower piezoelectric sheet 21 has narrow drive electrodes 24 formed on its top face and each positioned over one of the pressure chambers 16 of the cavity plate 10. The outer ends 24*a* of the drive electrodes 24 are exposed on the front and back side faces 20*c* of the piezoelectric actuator 20, which are perpendicular to the top face 20*a* and the bottom face 20*b* of the actuator 20. This piezoelectric sheet 21 also has dummy electrodes 28.

The upper piezoelectric sheet 22 has a common electrode 25 formed on its top face and positioned over the drive electrodes 24. The common electrode 25 includes four terminals 25*a* exposed on the side faces 20*c* of the piezoelectric actuator 20. This piezoelectric sheet 22 also has dummy electrodes 129.

The insulating sheet 23 has top electrodes 26 and 27 formed on its top face along the side faces 20*c* of the piezoelectric actuator 20. Each of the top electrodes 26 is positioned over one of the drive electrodes 24. Each of the top electrodes 27 is positioned over one of the terminals 25*a* of the common electrode 25.

The piezoelectric actuator 20 has first grooves 30 and second grooves 31 formed in the side faces 20*c* and extending vertically. The outer end 24*a* of each drive electrode 24 is exposed in one of the first grooves 30. Each terminal 25*a* of the common electrode 25 is exposed in one of the second grooves 31.

A side electrode 32 is formed in each first groove 30, and connects the associated drive electrode 24 and top electrode 26. A side electrode 33 is formed in each second groove 31, and connects the associated terminal 25*a* of the common electrode 25 with the associated top electrode 27.

The piezoelectric actuator 20 might include two or more piezoelectric sheets 21 each having drive electrodes 24 and two or more piezoelectric sheets 22 each having a common electrode 25. Each of these piezoelectric sheets 21 pairs with one of these piezoelectric sheets 22.

The flexible flat cable 40 is pressed on the top face 20*a* of the piezoelectric actuator 20 so that the wiring patterns (not shown) of the cable 40 are connected with the top electrodes 26 and 27 of the actuator 20.

When voltage is applied between any of the drive electrodes 24 and the common electrode 25 of the piezoelectric actuator 20, those portions of the piezoelectric sheets 21 and 22 which are positioned over and under this particular drive electrode or these particular drive electrodes 24 deform piezoelectrically in the downward direction. The deformation reduces the volume of the associated pressure chamber or chambers 16. The volume reduction ejects ink in the pressure chamber or chambers 16 in the form of a droplet or droplets from the associated nozzle or nozzles 15, so that printing can be done.

The side electrodes 32 and 33 are formed in the grooves 30 and 31, respectively, in the side faces 20*c* of the piezoelectric actuator 20, so that these electrodes do not rise or protrude from the faces 20*c*. As a result, while the piezoelectric actuator 20 is produced or assembled, it is possible to reliably reduce the liability of the side electrodes 32 and 33 to be damaged by a handling tool (handler), a jig or the like coming into contact with them.

The piezoelectric actuator 20 can be produced as follows.

FIGS. 16–21 show a first production method embodying the present invention.

Figure 16:
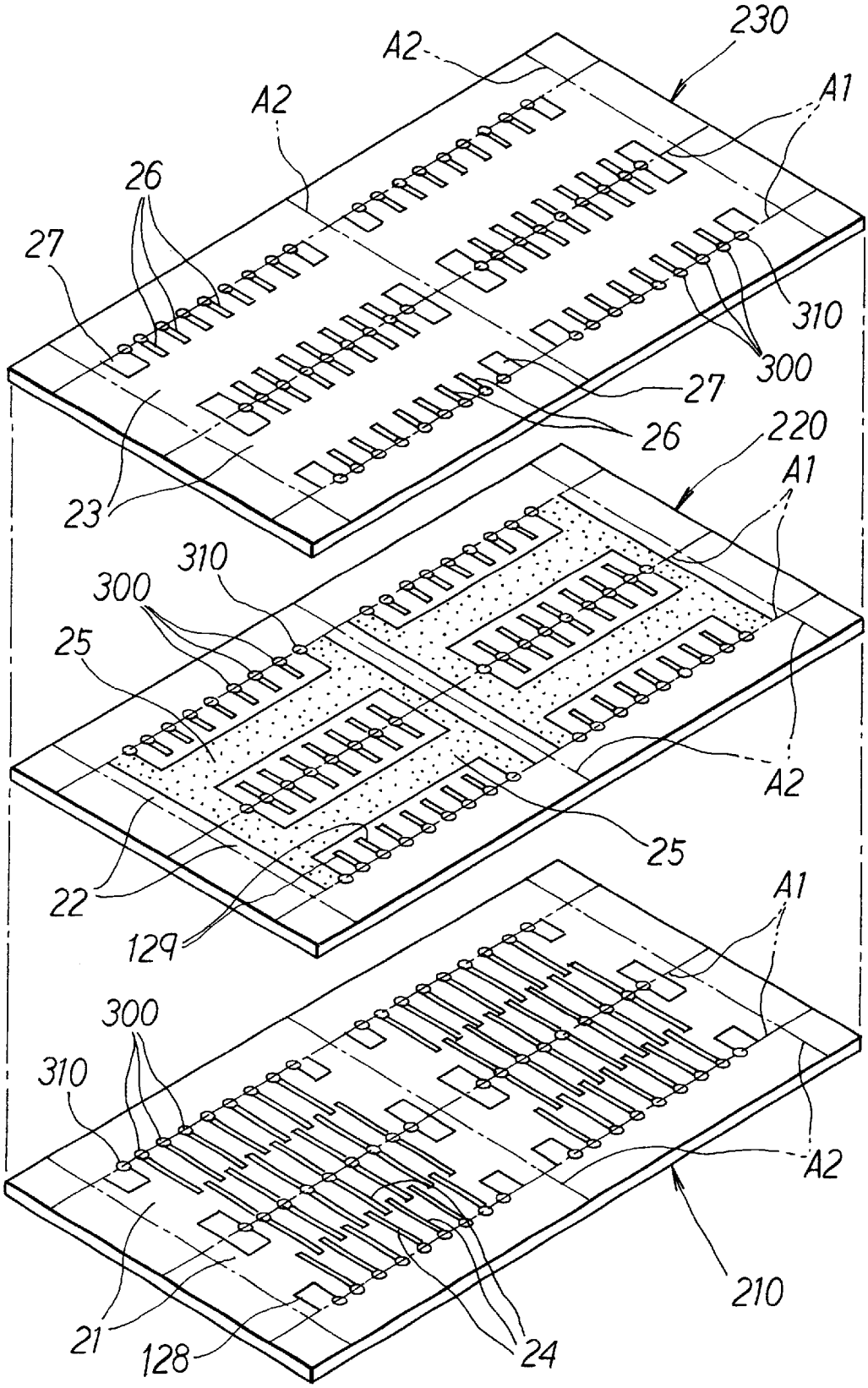
FIG. 16 is an exploded perspective view of the laminate used with a first production method according to the invention.

With reference to FIG. 16, a bottom ceramic green sheet 210 consists of four matrices 21 and margins defined with longitudinal boundaries A1 and lateral boudoirs A2. Each matrix 21 corresponds to the piezoelectric sheet 21 of the piezoelectric actuator 20 shown in FIGS. 9–15. A number of drive electrodes 24 and dummy electrodes 128 are screen-printed on the top faces of the matrices 21 with electrically conductive paste, which is subsequently dried. The electrodes 24 and 128 extend in parallel to the lateral boudoirs A2. The longer drive electrodes 24 and longer dummy electrodes 128 extend across the center longitudinal boundary A1. Some of the shorter electrodes 24 and 128 extend from one of the outer boudoirs A1 toward the center longitudinal boundary A1. The other shorter electrodes 24 and 128 extend from the other outer longitudinal boundary A1 toward the center longitudinal boundary A1.

Likewise, a middle ceramic green sheet 220 consists of four matrices 22 and margins defined with longitudinal boundaries A1 and lateral boudoirs A2. Each matrix 22 corresponds to the piezoelectric sheet 22 of the piezoelectric actuator 20 shown in FIGS. 9–15. Two common electrodes 25 and dummy electrodes 129 are screen-printed on the top faces of the matrices 22 with electrically conductive paste, which is subsequently dried. The common electrodes 25 partially extend across the center longitudinal boundary A1 to the outer longitudinal boudoirs A1.

Likewise, a top ceramic green sheet 230 consists of four matrices 23 and margins defined with longitudinal boundaries A1 and lateral boudoirs A2. Each matrix 23 corresponds to the insulating sheet 23 of the piezoelectric actuator 20 shown in FIGS. 9–15. Top electrodes 26 and 27 are screen-printed on the top faces of the matrices 23 with electrically conductive paste, which is subsequently dried. The top electrodes 26 and 27 extend in parallel to the lateral boudoirs A2. The longer electrodes 26 and 27 extend across the center longitudinal boundary A1. Some of the shorter electrodes 26 and 27 extend from one of the outer longitudinal boudoirs A1 toward the center longitudinal boundary A1. The other shorter electrodes 26 and 27 extend from the other outer longitudinal boundary A1 toward the center longitudinal boundary A1.

The longitudinal boudoirs A1 of the three green sheets 210, 220 and 230 are spaced at regular intervals, and the lateral boudoirs A2 of the green sheets are spaced at regular intervals.

Figure 17:
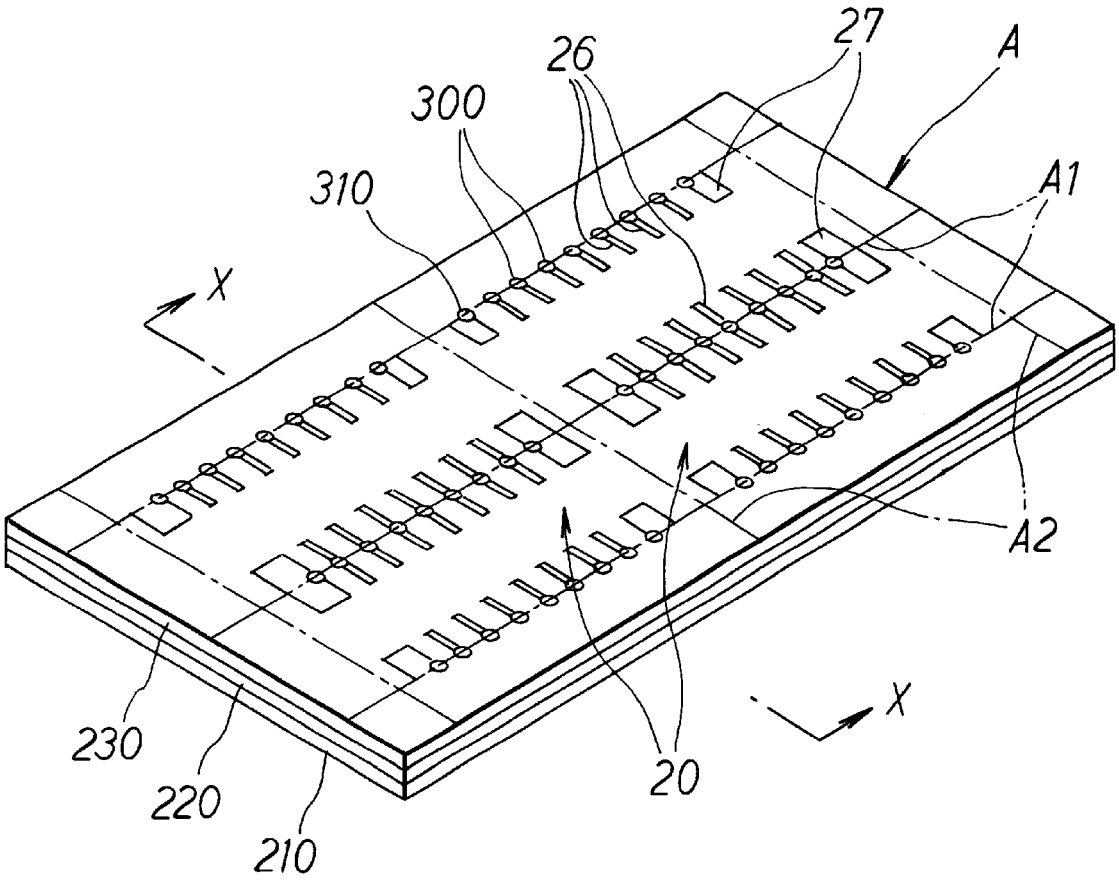
FIG. 17 is a perspective view of the laminate.
Figure 18:
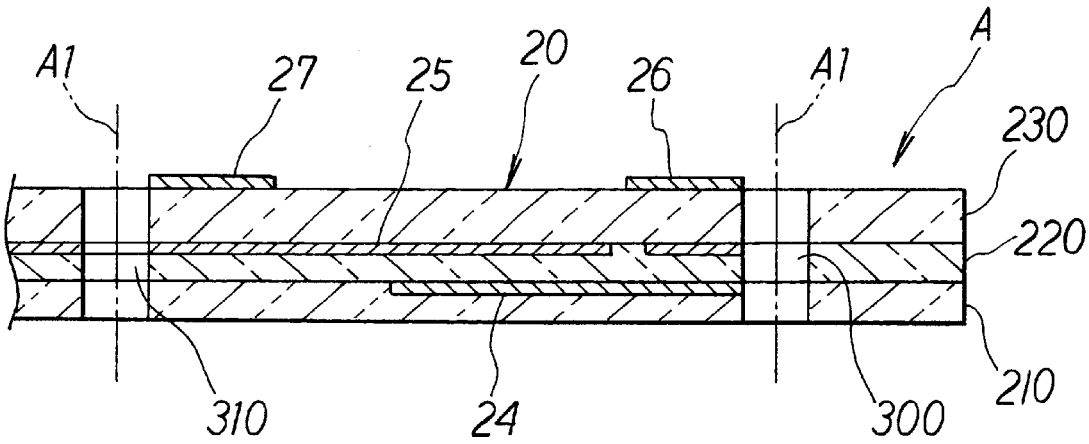
FIG. 18 is a partial cross section taken along line XVIII—XVIII of FIG. 17.

Subsequently, as shown in FIGS. 17 and 18, the green sheets 210, 220 and 230 are laminated together in such a manner that the boudoirs A1 and A2 of each green sheet are aligned with the boudoirs A1 and A2, respectively, of the others. When the green sheets are laminated, each longer electrode on the bottom green sheet 210 is aligned with one of the longer electrodes on the top green sheet 230, while each shorter electrode on the bottom green sheet 210 is aligned with one of the shorter electrodes on the top green sheet 230. When the green sheets are laminated, each common electrode 25 on the middle green sheet 220 covers the drive electrodes 24 on two of the matrices 21, while each of the top electrodes 27 is aligned with a portion of the common electrodes 25. The laminated sheets 210, 220 and 230 are pressed on each other to form a laminate A.

Subsequently, through holes 300 and 310 are punched in the laminate A at those points on the center longitudinal boundary A1 through which the longer top electrodes 26 and 27 respectively extend, and at those points on the outer longitudinal boudoirs A1 from which the shorter top electrodes 26 and 27 respectively extend. The drive electrodes 24 and common electrodes 25 are exposed in the respective holes 300 and 310.

Alternatively, the through holes 300 and 310 might be punched in the ceramic green sheets 210, 220 and 230 before the sheets are laminated together.

Figure 19:
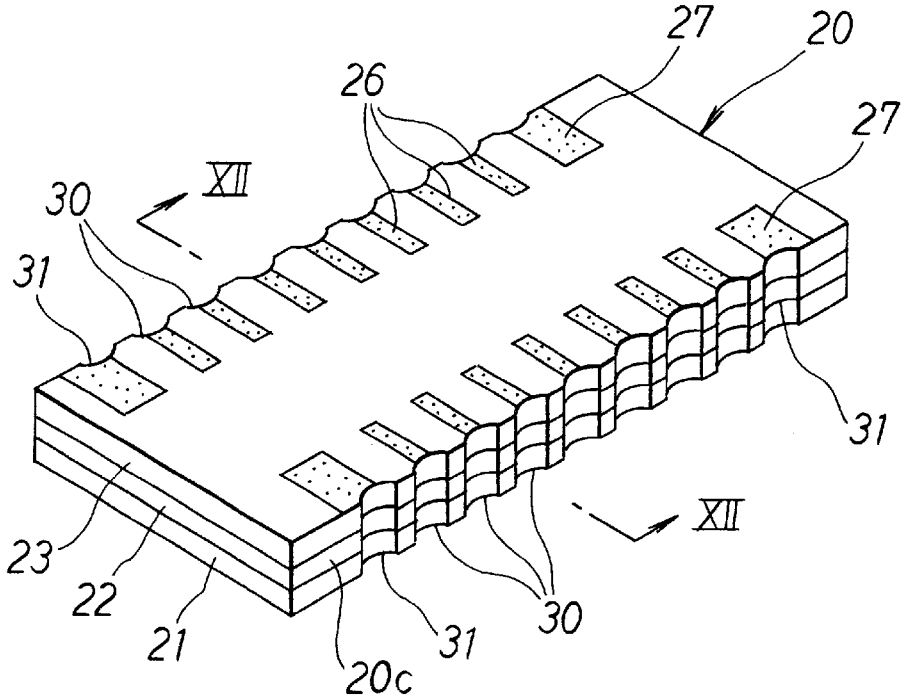
FIG. 19 is a perspective view of one of the piezoelectric actuators into which the laminate is divided.
Figure 20:
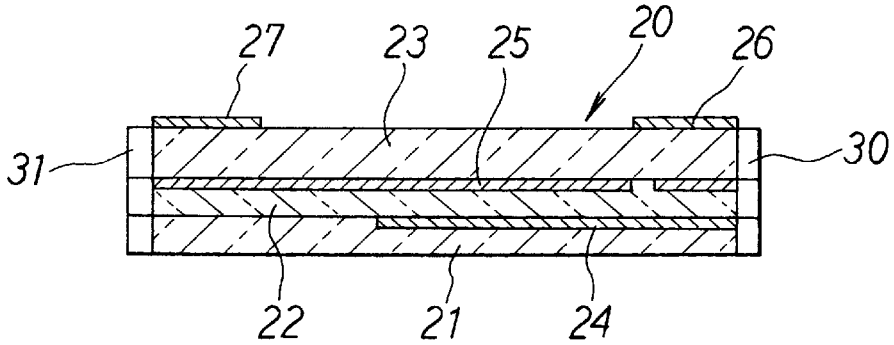
FIG. 20 is a cross section taken along line XX—XX of FIG. 19.

Subsequently, the laminate A is calcined at a high temperature. A dicing cutter (not shown) rotating at a high speed cuts the calcined laminate A along the boudoirs A1 and A2 to form four piezoelectric actuators 20, one of which is shown in FIGS. 19 and 20. This cuts the through holes 300 and 310 into vertical grooves 30 and 31, respectively, in the right and left side faces 20*c* of the actuators 20 and other vertical grooves (not shown) in marginal portions of the cut laminate A.

Figure 21:
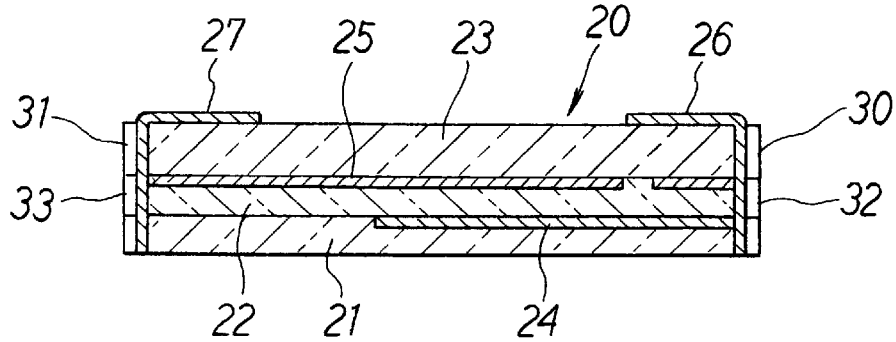
FIG. 21 is a cross section similar to FIG. 20, but showing the piezoelectric actuator formed with side electrodes.

Subsequently, as shown in FIG. 21, a side electrode 32 is formed in each vertical groove 30, and a side electrode 33 is formed in each vertical groove 31. This completes the piezoelectric actuators 20 each of the structure shown in FIG. 20. The side electrodes 32 and 33 are formed in the vertical grooves 30 and 31, respectively, by vacuum metallizing, metal spattering, conductive paste coating, or the like.

Figure 22:
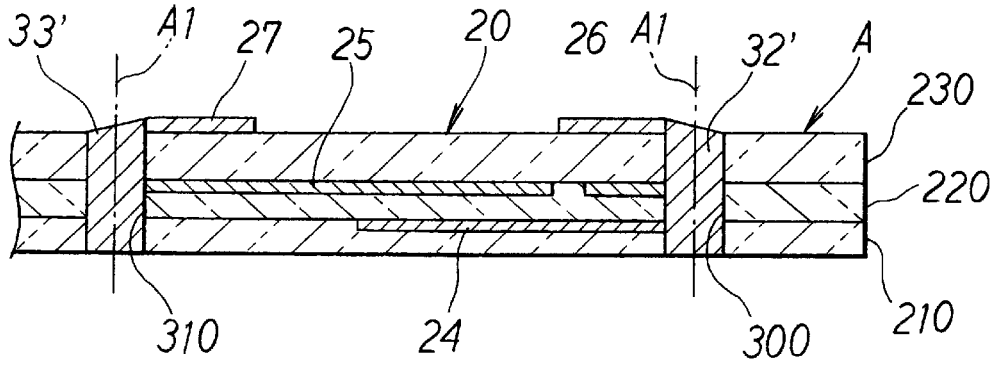
FIG. 22 is a cross section of a portion of the laminate used with a second production method according to the invention.
Figure 23:
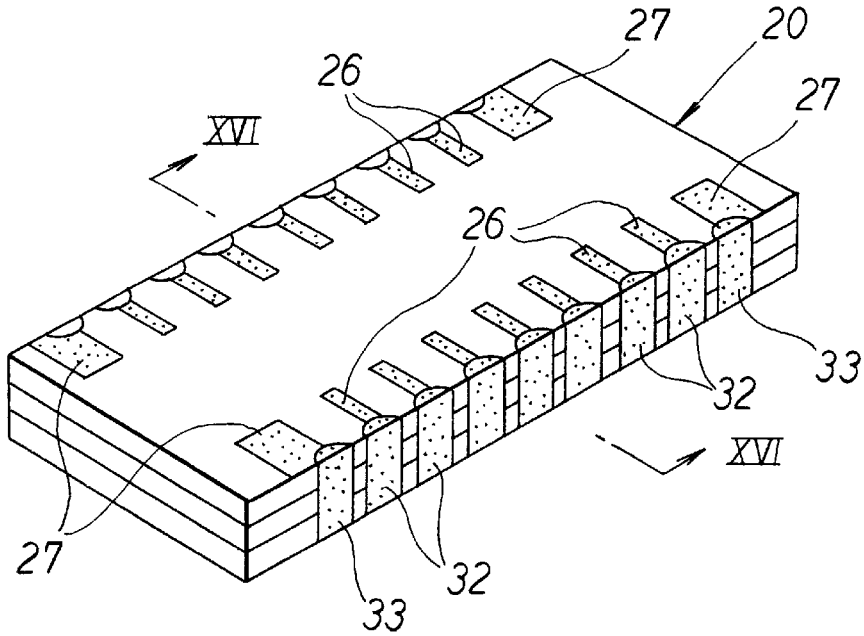
FIG. 23 is a perspective view of one of the piezoelectric actuators into which this laminate is divided.
Figure 24:
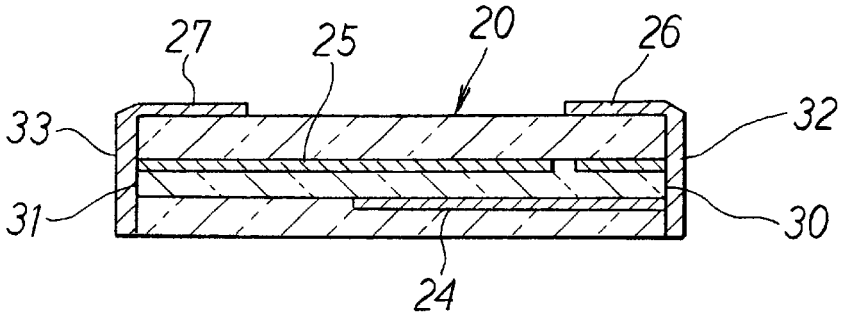
FIG. 24 is a cross section taken along line XXIV—XXIV of FIG. 23.

FIGS. 22–24 show a second production method embodying the present invention.

As shown in FIG. 22, this production method includes filling electrically conductive pastes 32' and 33' into the through holes 300 and 310, respectively, of a laminate A as shown in FIGS. 16–18, instead of forming side electrodes 32 and 33 as shown in FIG. 21. The method also includes drying the filled pastes 32' and 33', and subsequently calcining the laminate A at a high temperature. The method further includes cutting the calcined laminate A along the boundaries A1 and A2 (not shown) to form four piezoelectric actuators 20, one of which is shown in FIGS. 23 and 24. This cuts the through holes 300 and 310 into grooves 30 and 31, respectively, in the right and left side faces 20*c* of the piezoelectric actuators 20 and other grooves (not shown) in marginal portions of the cut laminate A. At the same time, each of the conductive pastes 32' and 33' in the holes 300 and 310 is cut into halves. This makes it possible to form side electrodes 32 and 33 in the grooves 30 and 31, respectively.

This production method makes it possible to form side electrodes 32 and 33 at a lower cost than the first production method, which involves forming side electrodes 32 and 33 for each piezoelectric actuator 20 after cutting the laminate A.

Figure 25:
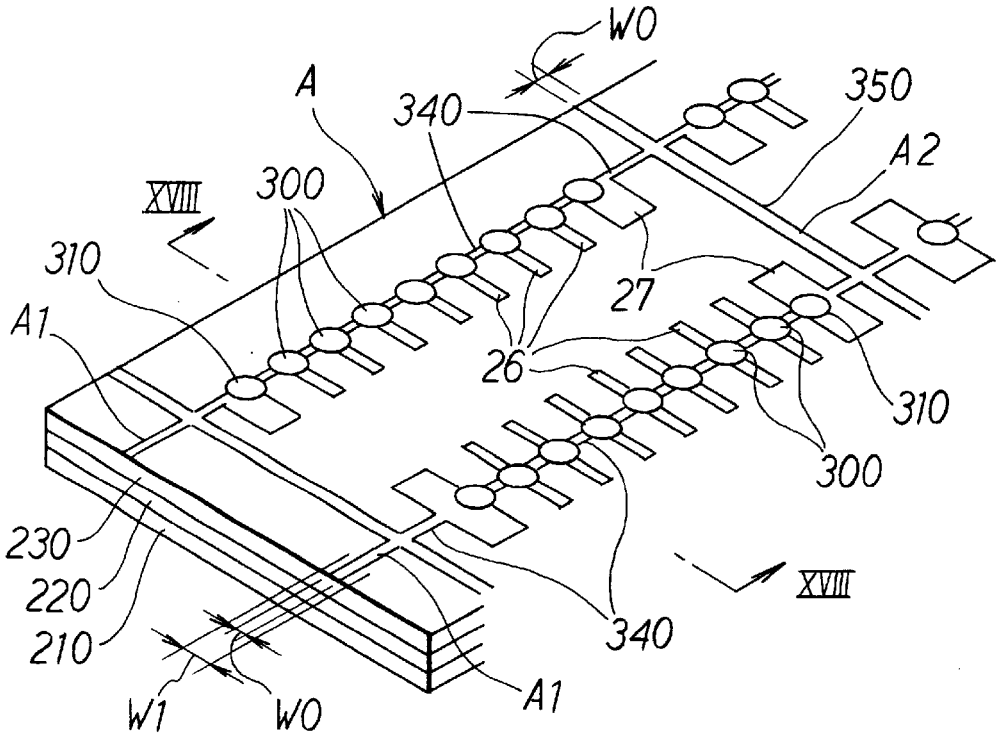
FIG. 25 is a perspective view of a portion of the laminate used with a third production method according to the invention.
Figure 26:
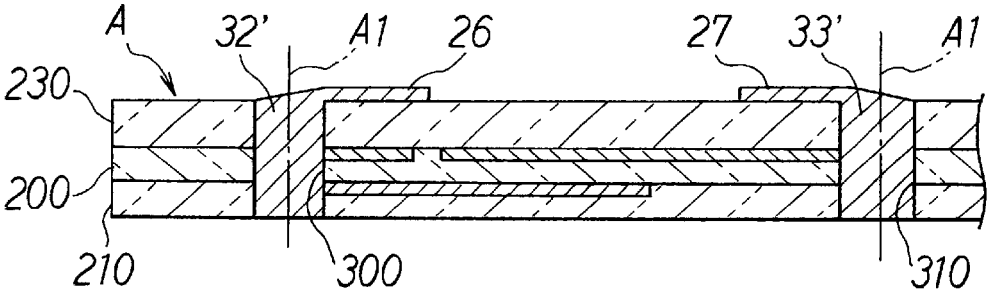
FIG. 26 is a cross section taken along line XXVI—XXVI of FIG. 25.
Figure 27:
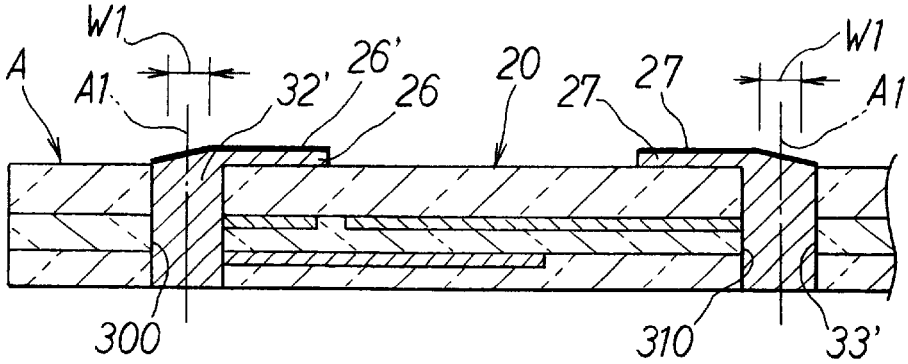
FIG. 27 is a cross section similar to FIG. 26, but showing the laminate formed with metal skins or metallic deposits.

FIGS. 25–27 show a third production method embodying the present invention.

As shown in FIG. 25, this production method also includes screen-printing top electrodes 26 and 27 with electrically conductive paste on a top ceramic green sheet 230 as shown in FIGS. 16–18. At the same time that the top electrodes 26 and 27 are printed, electrode patterns 340 and 350 are formed on this green sheet 230 along the boudoirs A1 and A2, respectively, in such a manner that the electrode patterns connect the top electrodes electrically together. The electrode patterns 340 and 350 have a narrow width W0. Subsequently, the top ceramic green sheet 230, and a middle ceramic green sheet 220 and a bottom ceramic green sheet 210 as shown in FIGS. 16–18 are laminated together and form a laminate A.

Subsequently, through holes 300 and 310 are formed in the laminate A and, as shown in FIG. 26, filled with electrically conductive pastes 32' and 33', respectively, which are subsequently dried. After the conductive pastes are dried, the laminate A is calcined at a high temperature.

Figure 9:
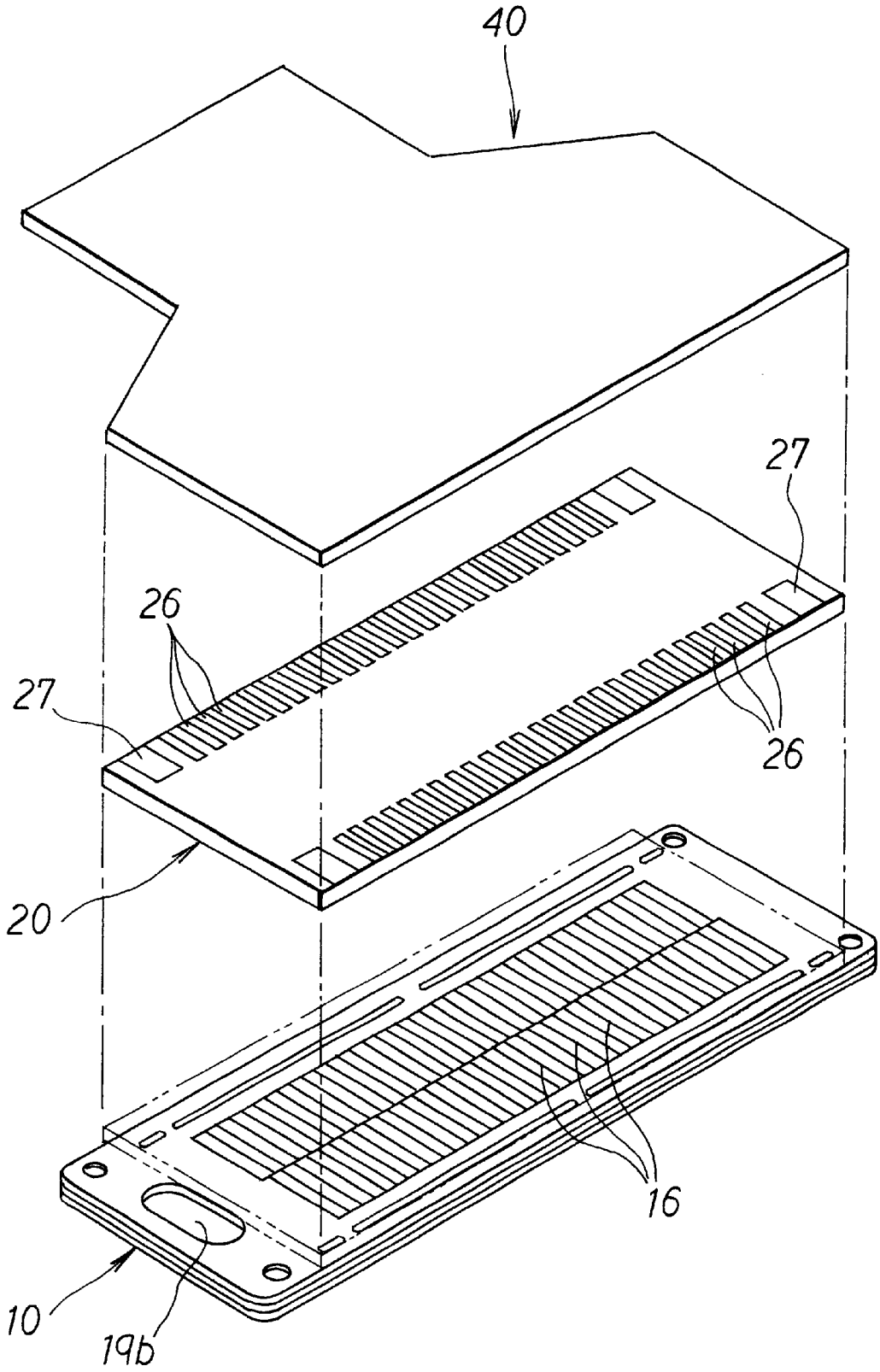
FIG. 9 is an exploded perspective view of another print head embodying the invention for a piezoelectric ink jet printer.

Subsequently, the laminate A is dipped or immersed in a plating solution. While the laminate A is dipped, electric current is applied to the top electrodes 26 and 27 via the narrow electrode patterns 340 and 350 to electroplate these electrodes. As shown in FIG. 27, the electroplating forms metal skins or metallic deposits 26' and 27' on the top electrodes 26 and 27, respectively. Each metal skin 26' or 27' may include a nickel layer as an under layer, which is covered with a gold layer. The formation of metal skins 26' and 27' greatly improves the electric connection of the top electrodes 26 and 27, respectively, with the wiring patterns of a flexible flat cable 40 as shown in FIG. 9.

Subsequently, a dicing cutter (not shown) rotating at a high speed cuts the laminate A along the boudoirs A1 and A2 to form four piezoelectric actuators 20. The dicing cutter has a width of cut W1 wider than the width W0 of the electrode patterns 340 and 350 for electroplating. At the same time that the dicing cutter cuts the laminate A into piezoelectric actuators 20, this cutter can remove the electrode patterns 340 and 350 to electrically insulate or isolate the top electrodes 26 and 27 from each other and the side electrodes 32 and 33 from each other.

Needless to say, instead of filling the through holes 300 and 310 with electrically conductive paste, this production method might, as is the case with the first method, involve forming side electrodes 32 and 33 by vacuum metallizing or the like in the vertical grooves 30 and 31, respectively, of the piezoelectric actuators 20 after cutting the laminate A.

With regard to a structure of a piezoelectric ink jet printer and a manufacturing process therefore, the content of U.S. Pat. No. 5,402,159 has been incorporated herein by reference.

What is claimed is:

1. A piezoelectric ink jet printer print head comprising:

a piezoelectric actuator in the form of a plate including a first piezoelectric sheet having a first face and a second face opposed the first face, and a side face connecting the first and second faces, the piezoelectric actuator further including a plurality of drive electrodes lying on the second face of the sheet, a common electrode lying on the first face of the piezoelectric sheet so as to position over the drive electrodes, and side electrodes formed on the side face of the sheet so as to be connected to the drive electrodes; and a cavity plate having pressure chambers open on one side of the plate, nozzles each communicating with one of the chambers, and a recess formed on the one side;

the piezoelectric actuator lying on the one side of the cavity plate in such a manner that the actuator closes the pressure chambers, the drive electrodes being each aligned with one of the chambers, the side electrodes being aligned with the recess to be kept out of contact with the cavity plate.

2. The print head according to claim 1, wherein the piezoelectric actuator further includes outer electrodes formed on a surface of the actuator which is opposed to a surface of the actuator covering the cavity plate, the outer electrodes being each connected to one of the side electrodes.

3. The print head according to claim 2, wherein the recess of the cavity plate is a groove extending along the side face of the piezoelectric actuator.

4. The print head according to claim 2, wherein the piezoelectric actuator further includes:

a second piezoelectric sheet lying on the first piezoelectric sheet; and a third piezoelectric sheet lying between the first piezoelectric sheet the one side of the cavity plate;

whereby the common electrode lies between the first and second piezoelectric sheets, the drive electrodes lie between the first and third piezoelectric sheets and the outer electrodes lies on the second piezoelectric sheet.

5. The print head according to claim 1, wherein the cavity plate includes a base sheet lying on the one side of the cavity plate, the recess being a slot punched in the base sheet.

6. The piezoelectric ink jet printer print head according to claim 1, wherein the side electrodes are connected to the common electrode.

7. A piezoelectric ink jet printer print head comprising:

a cavity plate having a plurality of nozzles and pressure chambers each communicating with one of the nozzles;

a piezoelectric actuator in the form of a plate which is placed on the cavity plate and includes a piezoelectric sheet having a first face and a second face opposed to the first face and a side face connecting the first and second faces;

drive electrodes lying on the second face of the piezoelectric sheet and each exposed in one of the recesses, the drive electrodes being each aligned with one of the pressure chambers;

side electrodes each formed in one of the recesses and each connected to the drive electrode exposed in the associated recess; and a common electrode lying on the first face of the piezoelectric sheet over the drive electrodes.

8. The piezoelectric ink jet printer print head according to claim 7, further comprising outer electrodes formed on a surface of the actuator which is opposed to a surface of the actuator covering the cavity plate, the outer electrodes being each connected to one of the side electrodes.

9. The piezoelectric ink jet printer print head according to claim 8, further comprising:

an insulating sheet lying on the first piezoelectric sheet; and a second piezoelectric sheet lying between the first piezoelectric sheet and the one side of the cavity plate;

whereby the common electrode lies between the insulating sheet and the first piezoelectric sheet, the drive electrodes lie between the first and second piezoelectric sheets, and the outer electrodes lie on the insulating sheet.

10. The piezoelectric ink jet printer print head according to claim 8, wherein the side electrodes are connected to the common electrode.

11. A piezoelectric actuator in the form of a plate for a piezoelectric ink jet printer print head including a cavity plate on which the actuator is placed, the cavity plate having a plurality of nozzles and pressure chambers each communicating with one of the nozzles, the actuator comprising:

a piezoelectric sheet having a first face and a second face opposed to the first face and a side face connecting the first and second faces, the side face having recesses formed thereon;

drive electrodes lying on the second face of the piezoelectric sheet and each exposed in one of the recesses, the drive electrodes being each aligned with one of the pressure chambers;

side electrodes each formed in one of the recesses and each connected to the drive electrode exposed in the associated recess; and a common electrode lying on the first face of the piezoelectric sheet over the drive electrodes.

12. The piezoelectric actuator according to claim 11, further comprising outer electrodes formed on a surface of the actuator which is opposed to a surface of the actuator covering the cavity plate, the outer electrodes being each connected to one of the side electrodes.

13. The piezoelectric actuator according to claim 11, further comprising:

an insulating sheet lying on the first piezoelectric sheet; and a second piezoelectric sheet lying between the first piezoelectric sheet and the cavity plate;

whereby the common electrode lies between the insulating sheet and the first piezoelectric sheet, the drive electrodes lie between the first and second piezoelectric sheets, and the outer electrodes lie on the insulating sheet.

* * * * *